US011743632B2

(12) United States Patent
Okazaki et al.

(10) Patent No.: US 11,743,632 B2
(45) Date of Patent: Aug. 29, 2023

(54) ELECTRONIC DEVICE

(71) Applicant: NINTENDO CO., LTD., Kyoto (JP)

(72) Inventors: Yuya Okazaki, Kyoto (JP); Kumpei Fujita, Kyoto (JP)

(73) Assignee: Nintendo Co., Ltd., Kyoto (JP)

( * ) Notice: Subject to any disclaimer, the term of this patent is extended or adjusted under 35 U.S.C. 154(b) by 75 days.

(21) Appl. No.: 17/583,951

(22) Filed: Jan. 25, 2022

(65) Prior Publication Data

US 2023/0007388 A1 Jan. 5, 2023

(30) Foreign Application Priority Data

Jun. 30, 2021 (JP) ..... 2021-109357

(51) Int. Cl.
*H04R 1/28* (2006.01)
*H04R 1/02* (2006.01)

(52) U.S. Cl.
CPC ..... *H04R 1/2803* (2013.01); *H04R 1/02* (2013.01); *H04R 1/023* (2013.01); *H04R 1/025* (2013.01); *H04R 1/288* (2013.01); *H04R 1/2811* (2013.01); *H04R 2499/11* (2013.01); *H04R 2499/15* (2013.01)

(58) Field of Classification Search
CPC ..... H04R 1/02; H04R 1/023; H04R 1/025; H04R 1/2803; H04R 1/2811; H04R 1/288; H04R 2499/11; H04R 2499/15; G10K 9/12
See application file for complete search history.

(56) References Cited

U.S. PATENT DOCUMENTS 6,526,150 B2 * 2/2003 Kelly ..... H04M 1/03 381/345
6,760,460 B1 * 7/2004 Jeon ..... H04N 5/642 381/388

(Continued)

FOREIGN PATENT DOCUMENTS

EP 2 905 973 8/2015
GB 2 349 037 10/2000

(Continued)

OTHER PUBLICATIONS

Extended European Search Report dated Jul. 15, 2022 in European Application No. 22153246.8, 7 pages.

*Primary Examiner* — Huyen D Le
(74) *Attorney, Agent, or Firm* — Nixon & Vanderhye PC

(57) ABSTRACT

An electronic device having a speaker includes: a housing having a front wall member; a cover member detachably attached to the front wall member; a fastening member arranged behind the cover member and fastened to the housing; and a first elastic member provided between the cover member and the fastening member. The cover member, the fastening member, and the first elastic member are arranged inside the housing. The speaker is arranged between the front wall member and the cover member. The front wall member and the cover member are formed so that a closed space is defined by a back surface of a vibration plate, the front wall member, and the cover member. The front wall member is provided with an opening communicating from outside of the housing to the front surface of the vibration plate. The first elastic member contacts the cover member and the fastening member.

20 Claims, 17 Drawing Sheets

(56) References Cited

U.S. PATENT DOCUMENTS

| | | | | |
|---|---|---|---|---|
| 7,995,786 | B2 * | 8/2011 | Yu | H04R 1/025 381/388 |
| 2014/0177902 | A1 | 6/2014 | Yeh | |
| 2019/0364357 | A1 | 11/2019 | Haastrup et al. | |

FOREIGN PATENT DOCUMENTS

| | | |
|---|---|---|
| JP | 2014-123946 | 7/2014 |
| WO | 2011/039842 | 4/2011 |

* cited by examiner

ELECTRONIC DEVICE

CROSS-REFERENCE TO RELATED APPLICATION

The present application claims priority to Japanese Patent Application No. 2021-109357 filed on Jun. 30, 2021, which is incorporated herein by reference in its entirety including the specifications, drawings and abstract.

FIELD

The present disclosure relates to an electronic device.

BACKGROUND

Known in the past has been an electronic device having speakers (for example, JP 2014-123946 A). In particular, in the electronic device described in JP 2014-123946 A, five recesses are provided in the housing, some of the recesses are connected with each other, and two of the recesses among them house speakers and are provided with sound emitting holes.

In the electronic device described in JP 2014-123946 A, there has been room for improvement of the sealability of the spaces in which the speakers are housed.

SUMMARY

The gist of the present disclosure is as follows:

(1) An electronic device having a speaker, the electronic device comprising:

a housing having a front wall member including a front wall and a back wall member including a back wall;

a cover member detachably attached to the front wall member;

a fastening member arranged behind the cover member and fastened to the housing; and a first elastic member provided between the cover member and the fastening member, wherein the cover member, the fastening member, and the first elastic member are arranged inside the housing, the speaker is arranged between the front wall member and the cover member, the front wall member and the cover member are formed so that a closed space is defined by a back surface of a vibration plate of the speaker, the front wall member, and the cover member, the front wall member is provided with an opening communicating from outside of the housing to the front surface of the vibration plate of the speaker, and the first elastic member is configured to contact the cover member and the fastening member.

(2) The electronic device according to the above (1), wherein the front wall member has a loop-shaped rib extending from an inside surface of the front wall toward the back, the speaker is arranged inside the loop-shaped rib, and the cover member is attached to a back end of the loop-shaped rib.

(3) The electronic device according to the above (1) or (2), wherein the cover member is fastened to the front wall member at two different locations of the outer circumferential part of the cover member, and the first elastic member is arranged so as to contact a different location of the cover member from the location fastened to the front wall member.

(4) The electronic device according to any one of the above (1) to (3), wherein the cover member is provided with a ceiling part having a shape obtained by removing one edge part of a rectangular shape and is fastened to the front wall member at an edge part adjoining the removed edge part, and the first elastic member is arranged so as to contact the cover member at a region nearer to the edge part of the cover member not fastened to the front wall member than the edge part of the cover member fastened to the front wall member.

(5) The electronic device according to the above (4), wherein the cover member is fastened to two edge parts adjoining the removed edge part.

(6) The electronic device according to the above (4) or (5), wherein one edge part of the cover member fastened to the front wall member is provided with a tab and the other edge part of the cover member fastened to the front wall member is provided with a screw opening for passing a screw, and the cover member is fastened by the tab being inserted into a tab opening or tab recess formed in the front wall member and by a screw passed through the screw opening being screwed into the front wall member.

(7) The electronic device according to any one of the above (4) to (6), wherein the cover member is attached to the front wall member so that an edge part positioned diagonally from the removed edge part is positioned at an edge part of the housing.

(8) The electronic device according to any one of the above (1) to (3), wherein the cover member is provided with an L-shaped ceiling part having a first part extending in a first direction and a second part extending in a second direction perpendicular to the first direction, and the first elastic member is arranged so as to contact the cover member in a region including a part where the first part and the second part cross.

(9) The electronic device according to the above (8), wherein the cover member is fastened to the front wall at an end part of the first part at an opposite side to the crossing part side and at an end part of the second part at an opposite side to the crossing part side.

(10) The electronic device according to the above (8) or (9), wherein an end part of the first part at an opposite side to the crossing part side is provided with a tab and an end part of the second part at an opposite side to the crossing part side is provided with a screw opening for passing a screw at, and the cover member is fastened by the tab being inserted into a tab opening or tab recess formed in the front wall member and by a screw passed through the screw opening being screwed into the front wall member.

(11) The electronic device according to any one of the above (8) to (10), wherein the cover member is attached to the front wall member so that the crossing part is positioned at an edge part of the housing.

(12) The electronic device according to any one of the above (1) to (11), wherein the first elastic member is adhered to the fastening member and is not adhered to the cover member.

(13) The electronic device according to any one of the above (1) to (12), wherein a second elastic member is arranged between the cover member and the front wall member, and the cover member and the front wall member are detachably adhered to each other by the second elastic member.

(14) The electronic device according to the above (13), wherein the second elastic member formed to have a thickness larger than a clearance between the cover member and the front wall member when the cover member is fastened to the front wall member.

(15) The electronic device according to the above (14), wherein the second elastic member is arranged between an end surface at the front wall member side of the cover member and an end surface at the cover member side of the front wall member, and is formed so as to stick out from between these end surfaces inward or outward.

(16) The electronic device according to any one of the above (1) to (15), wherein the fastening member is fastened to the front wall member.

(17) The electronic device according to any one of the above (1) to (16), wherein the back wall member has a back wall rib extending from an inside surface of the back wall toward the fastening member.

(18) The electronic device according to the above (17), wherein the back wall rib is arranged so as to face the fastening member more at the first elastic member side than the location where the fastening member is fastened to the housing.

(19) The electronic device according to the above (17) or (18), wherein the fastening member is a circuit board, the circuit board is provided with a slot in which a peripheral device is loaded through an opening provided at the back wall member from outside the housing, and the back wall rib is arranged around the slot.

(20) The electronic device according to any one of the above (17) to (19), wherein the front wall member is made of a metal and the back wall member is made of a plastic.

(21) The electronic device according to any one of the above (17) to (20), wherein the cover member is made of a plastic harder than the back wall member.

BRIEF DESCRIPTION OF DRAWINGS

Embodiments of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DESCRIPTION OF EMBODIMENTS

Figure 1:
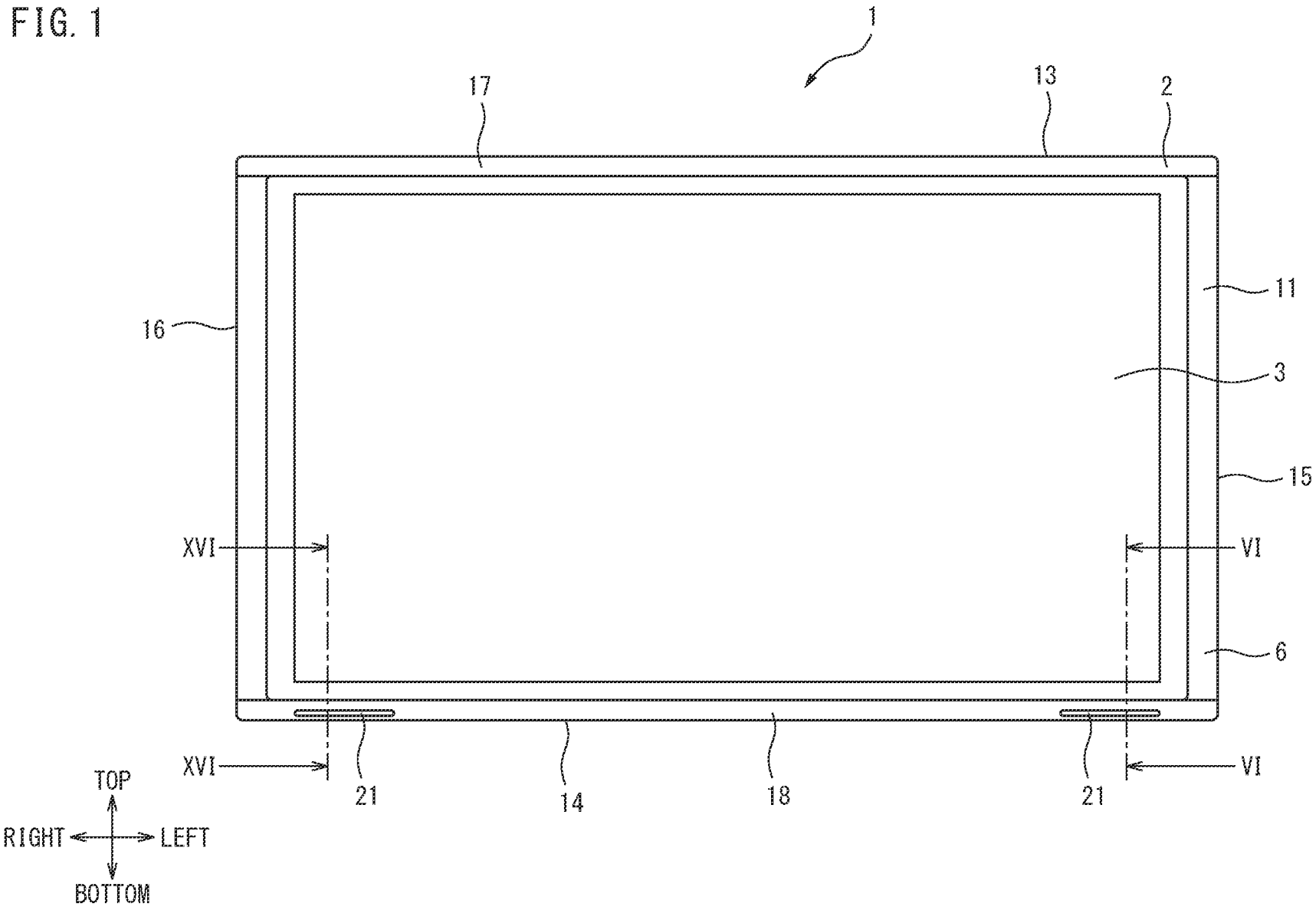
FIG. 1 is a front view of an electronic device.

Below, referring to the drawings, embodiments will be explained in detail. Note that, in the following explanation, similar components will be assigned the same reference notations.

Overall Configuration of Electronic Device

Referring to FIGS. 1 to 5, the overall configuration of an electronic device 1 according to one embodiment will be explained. The electronic device 1 is a substantially cuboid-shaped device provided with a display, and is, for example, a portable game device, tablet, mobile monitor, or the like. In particular, in the present embodiment, the electronic device 1 is a portable device used in a state placed on a placement surface such as the floor surface, a table top, or in a state held by a hand of a user.

Figure 2:
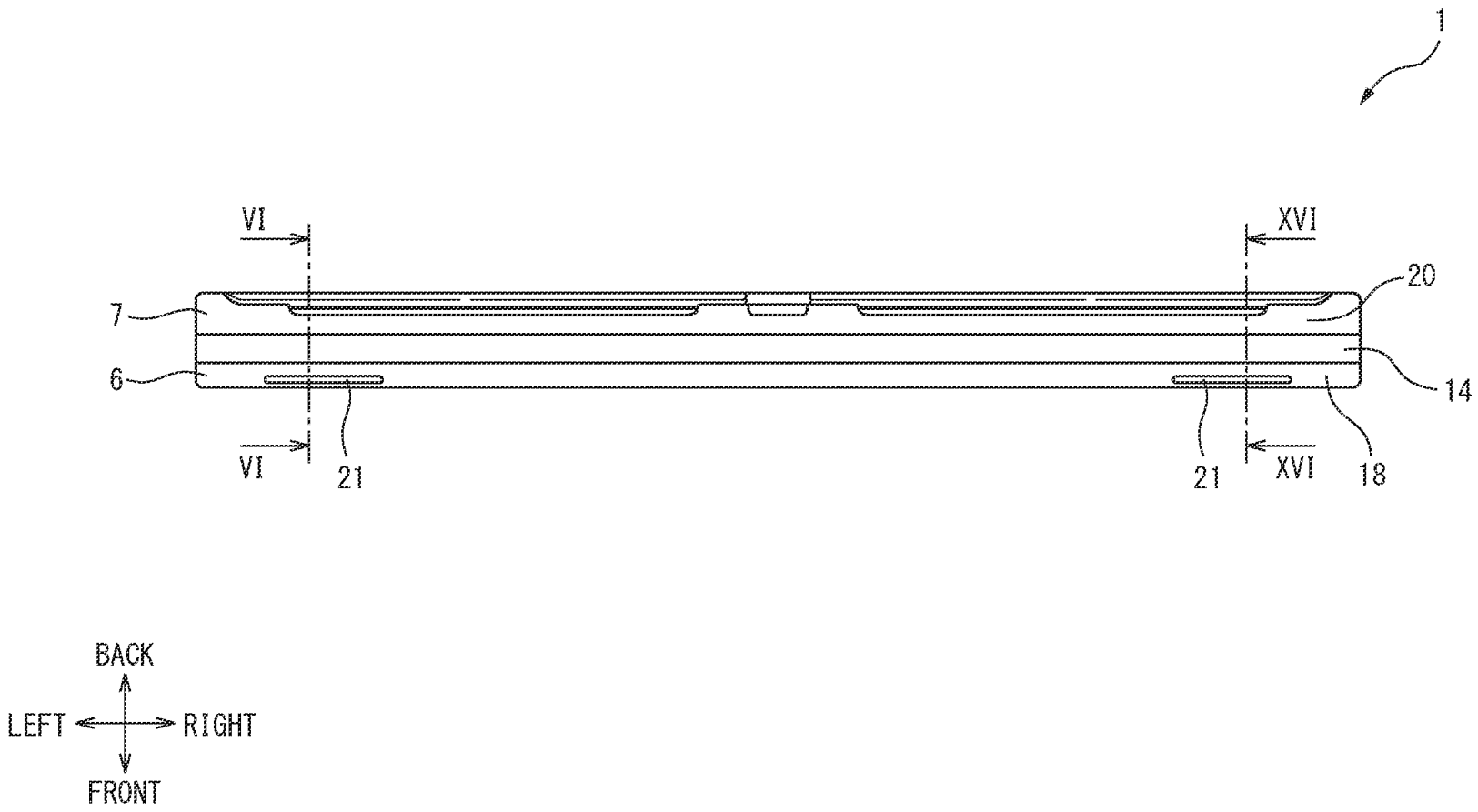
FIG. 2 is a bottom view of the electronic device.
Figure 3:
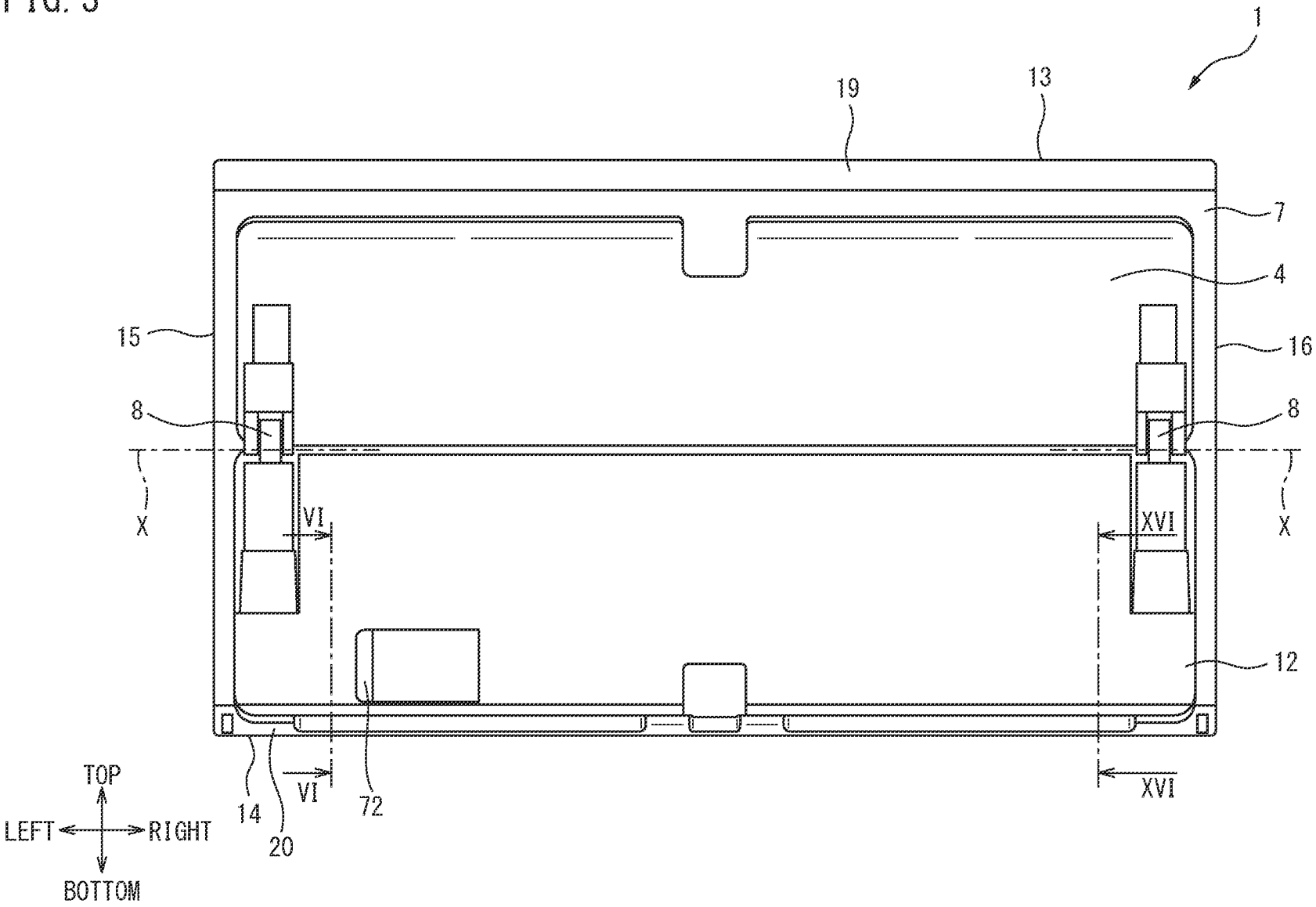
FIG. 3 is a back view of the electronic device.
Figure 4:
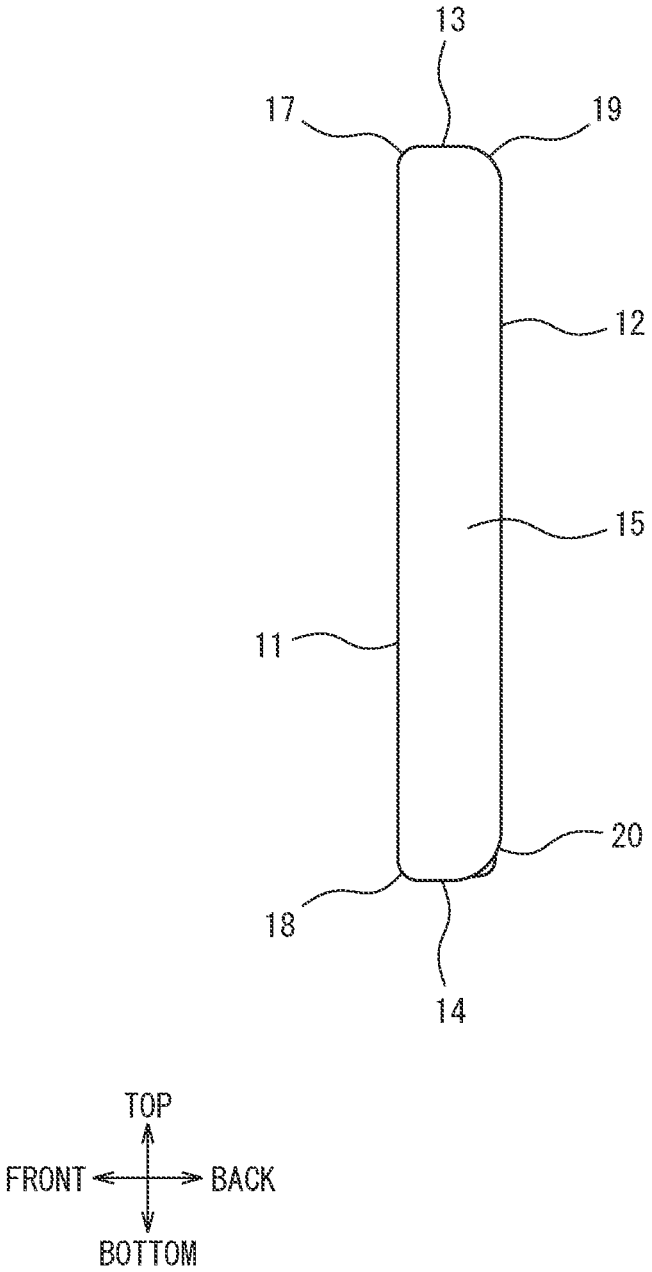
FIG. 4 is a side view of the electronic device seen from a left side.
Figure 5:
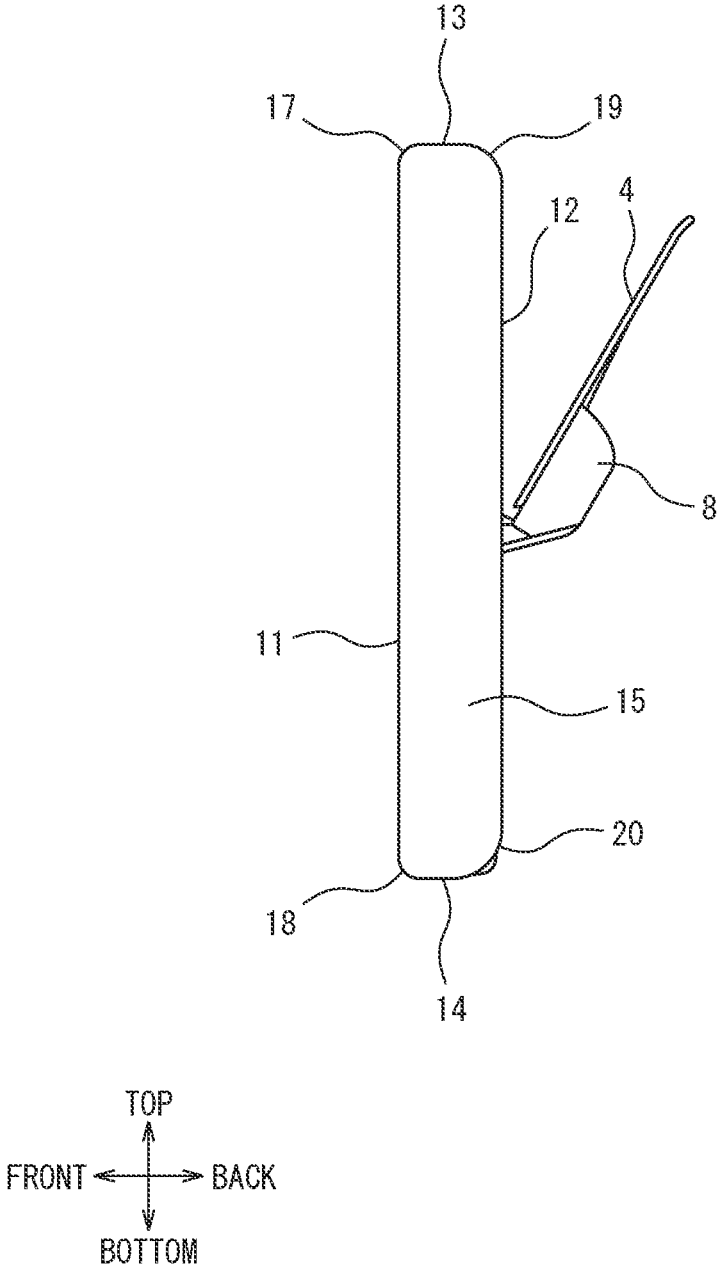
FIG. 5 is a side view of the electronic device seen from a left side.

FIG. 1 is a front view of the electronic device 1, FIG. 2 is a bottom view of the electronic device 1, and FIG. 3 is a back view of the electronic device 1. FIGS. 4 and 5 are side views of the electronic device 1 seen from a left side. FIGS. 2 and 4 show the case in a closed state where a later explained stand is closed, while FIGS. 3 and 5 show the case in a state where the stand is opened the most.

As mainly shown in FIGS. 1 to 3, the electronic device 1 has a substantially cuboid-shaped housing 2, a display 3 provided at one broad surface side of the housing 2, and a stand 4 provided at a broad surface side of the housing 2 at the opposite side to the broad surface where the display 3 is provided. Note that, the housing 2 may be a shape other than a substantial cuboid shape so long as the display 3 is provided at one broad surface. Accordingly, the electronic device 1 may have a shape other than a substantial cuboid shape.

In this Description, the direction in which the display 3 is provided with respect to the housing 2 will be referred to as the "front", while the direction in which the stand 4 is provided with respect to the housing 2 will be referred to as the "back". Therefore, display 3 is provided at the front surface of the housing 2, while the stand 4 is provided at the back surface of the housing 2. Further, when the electronic device 1 is placed standing up perpendicularly with respect to the placement surface in a normal orientation, and the electronic device 1 id viewed from the back, the upper direction, lower direction, left direction, and right direction will be respectively referred to as the "top", "bottom", "left", and "right" of the electronic device 1 and its components. Further, the left-right direction of the electronic device 1 will also be referred to as the "lateral width direction".

Outside Configuration of Housing

As mainly shown in FIGS. 1 to 5, the housing 2 has a front wall 11 provided at a front side of the housing 2, a back wall 12 provided at a back side of the housing 2, and a top wall 13, and bottom wall 14, left wall 15, and right wall 16 provided between the front wall 11 and back wall 12. In particular, the top wall 13 is provided at the upper side of the housing 2, the bottom wall 14 is provided at the lower side of the housing 2, the left wall 15 is provided at the left side of the housing 2, and the right wall 16 is provided at the right side of the housing 2. In the present embodiment, these top wall 13, bottom wall 14, the left wall 15, and the right wall 16 extend perpendicularly with respect to the front wall 11 and back wall 12. Note that, "extend perpendicularly" includes not only the wall extending strictly perpendicularly, but also extending substantially perpendicularly. Further, in the present embodiment, a front surface of the front wall 11 and a back surface of back wall 12 are formed flat. In addition, in the present embodiment, a top surface of the top wall 13, a bottom surface of the bottom wall 14, a left surface of the left wall 15, and a right surface of the right wall 16 are also formed flat. Note that, "flat" includes not only the entirety being strictly flat, but also being substantially flat.

Further, as mainly shown in FIGS. 4 and 5, the housing 2 has a front top transition wall 17 curved by a constant curvature between the front wall 11 and the top wall 13, and a front bottom transition wall 18 curved by a constant curvature between the front wall 11 and the bottom wall 14. In addition, the housing 2 has a back top transition wall 19 curved by a constant curvature between the back wall 12 and the top wall 13, and has a back bottom transition wall 20 curved by a constant curvature between the back wall 12 and the bottom wall 14. Note that, these transition walls need not necessarily be curved by constant curvatures. Therefore, for example, the outside surface of the front bottom transition wall 18 may be slanted from the bottom wall 14 by a constant angle (for example, 45°).

In the present embodiment, the front top transition wall 17, front wall 11, front bottom transition wall 18, left wall 15, and right wall 16 are formed integrally as a front wall member 6. Therefore, the front wall member 6 includes the front top transition wall 17, front wall 11, front bottom transition wall 18, left wall 15, and right wall 16. In the present embodiment, the front wall member 6 is, for example, formed by a magnesium alloy or other metal. Note that, the front wall member 6 may be formed by a plastic or other material besides a metal. Further, the front wall member 6 need not include the front top transition wall 17, front bottom transition wall 18, left wall 15, or right wall 16 so long as including at least part of the front wall 11.

Further, in the present embodiment, the top wall 13, back top transition wall 19, back wall 12, back bottom transition wall 20, and bottom wall 14 are integrally formed as a back wall member 7. In the present embodiment, the back wall member 7 is, for example, formed by ABS or another plastic. Note that, the back wall member 7 may be formed by a metal or another material besides a plastic. Further, the back wall member 7 need not include the top wall 13, back top transition wall 19, back bottom transition wall 20, or bottom wall 14 so long as including at least part of the back wall 12.

As shown in FIG. 1, the display 3 is arranged on the front wall 11. In the present embodiment, the display 3 is provided over substantially the entire surface of the front wall 11, and has a flat surface. The display 3 is a device displaying a still image or moving image in accordance with a signal output from a video control device (not shown) provided inside the electronic device 1. The display 3 is, for example, a liquid crystal display, EL (Electro Luminescence) display, or plasma display. The display 3 may be provided on its surface with a touch panel functioning as an input device.

Further, as shown in FIGS. 1 and 2, the front bottom transition wall 18 is provided with speaker holes 21 passing through the front bottom transition wall 18. Therefore, the speaker holes 21 are provided at the front wall member 6 below the display 3. Further, in the present embodiment, the speaker holes 21 are formed so as to pass through the front bottom transition wall 18, that is, the front wall member 6.

In the present embodiment, the front bottom transition wall 18 is provided with a total of two, one each to the left and right, speaker holes 21. The left side speaker hole 21 is formed so as to extend in the left-right direction near the left wall 15, while the right side speaker hole 21 is formed so as to extend in the left-right direction near the right wall 16.

Note that, in the present embodiment, the speaker holes 21 are provided at the front bottom transition wall 18, but they may be provided at the front wall 11 above the front bottom transition wall 18. In this case, the speaker holes 21 are, for example, arranged below or to the side of the display 3. Further, in this case as well, the speaker holes 21 may be arranged one each to the left and right near the left wall 15 and the right wall 16.

Side walls including the top wall 13, bottom wall 14, the left wall 15, and right wall 16, can be provided with, for example, operating buttons or other input members (not shown). In addition, in the present embodiment, the electronic device 1 may be configured to enable communication with a separate operation input device such as a controller. In this case, the separate operation input device may be formed so as to be able to be attached to the left wall 15 and right wall 16 of the housing 2. On the left wall 15 and right wall 16 of the housing 2, fasteners for attaching the operation input device (for example, rails) may be provided.

In addition, the side walls including the top wall 13, bottom wall 14, the left wall 15 and the right wall 16 can be provided with, for example, slots for insertion of a memory card or other storage medium, or female connectors (ports or receptacles) into which male connectors are inserted for connection of other devices (for example, headphones, microphone, other display, etc.) The connectors may be USBs or other types of connectors based on general standards, or may be types of connectors based on unique standards.

As mainly shown in FIGS. 3 and 5, the back wall 12 is provided with a stand 4. The stand 4 is used for supporting the housing 2 at an angle with respect to the placement surface. The stand 4, as mainly shown in FIG. 5, is formed as a substantially flat single plate shape. As shown in FIG. 3, the stand 4 is attached to the housing 2 by hinge members 8. In the present embodiment, the hinge members 8 attach the stand 4 to the back wall member 7 so that the stand 4 can swing about a swing axis X (FIG. 3) extending in the lateral width direction near the center of the back wall 12. In particular, in the present embodiment, the stand 4 is attached to the back wall member 7 so that it can swing from the closed state shown in FIG. 4 to the fully open state shown in FIG. 5.

Configuration Around Speakers

Figure 6:
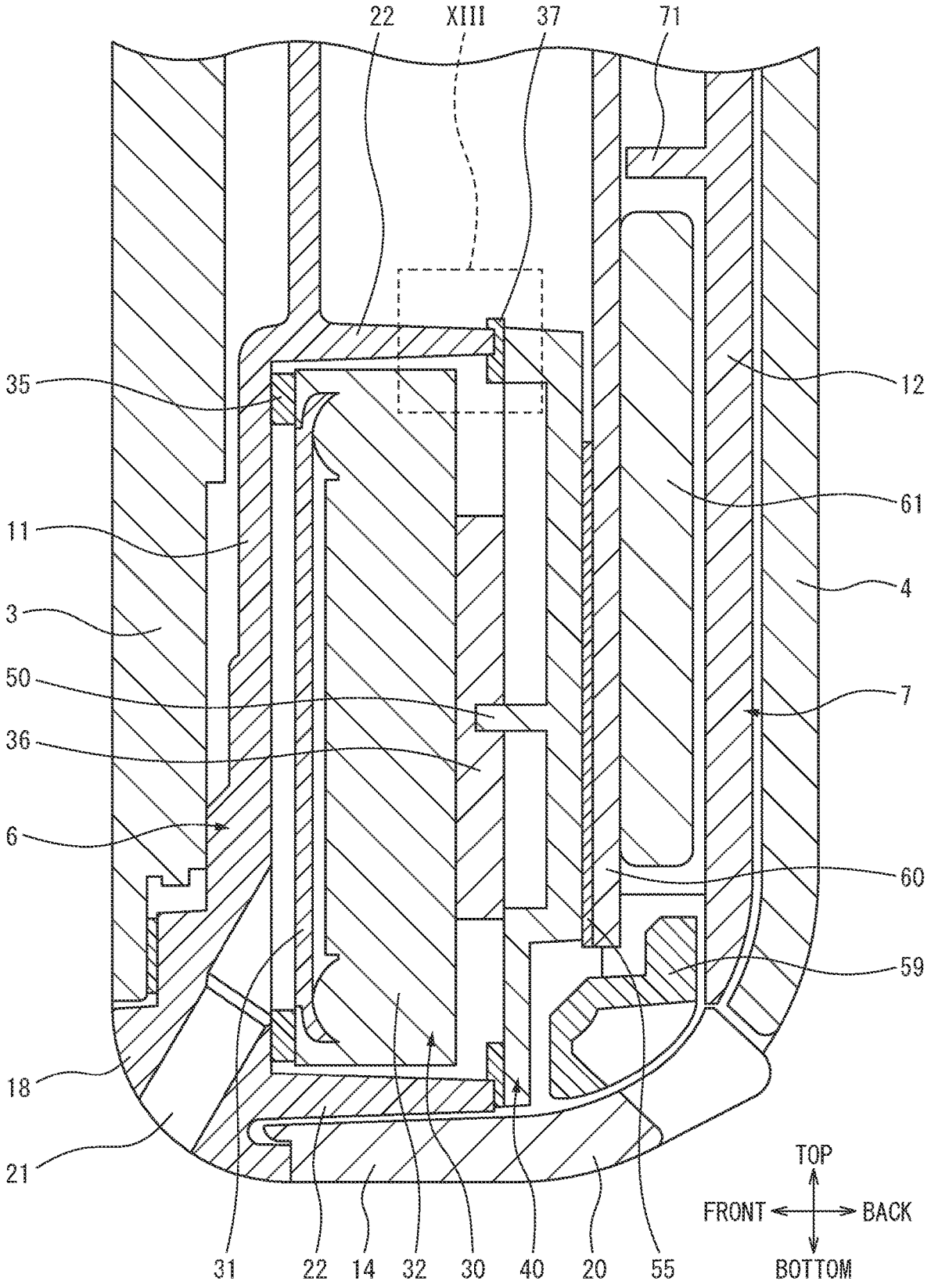
FIG. 6 is a cross-sectional view of a bottom left region of a housing, seen along a line VI-VI of FIGS. 1 to 3.

Next, referring to FIGS. 6 to 17, the configuration of the electronic device 1 around the speakers 30 will be explained. FIG. 6 is a cross-sectional view of the bottom left region of the housing 2, seen along the line VI-VI of FIGS. 1 to 3.

As shown in FIG. 6, the electronic device 1 has a front wall member 6, speakers 30, cover members 40, a circuit board 60, and a back wall member 7, in the direction from the front toward the back, at the bottom left region of the housing 2. Below, these components forming the electronic device 1 will be explained.

Front Wall Member

As explained above, the front wall member 6 includes the front wall 11, and configures part of the housing 2. As shown in FIG. 6, the display 3 is arranged at the front surface of the front wall member 6, while the front wall member 6 has the speaker holes 21 and loop-shaped ribs 22.

The speaker holes 21 are provided at the bottom part of the front wall member 6. As will be understood from FIG. 6, the speaker holes 21 pass through the front wall member 6 so that one of the ends is positioned at the outside surface of the front bottom transition wall 18 and the other of the ends is positioned at the inside surface of the front wall member 6. In particular, in the present embodiment, the speaker holes 21 pass through the front wall member 6 so as to extend downward at a slant toward the front.

The speaker holes 21 are used for taking out sound generated by the later explained speakers 30 to outside the housing 2. Therefore, when the stand 4 is used to support the housing 2 on the placement surface, the sound emitted from the speaker holes 21 strikes the placement surface to be reflected at the placement surface, the reflected sound is easily delivered to a user positioned in front of the electronic device 1.

Figure 7:
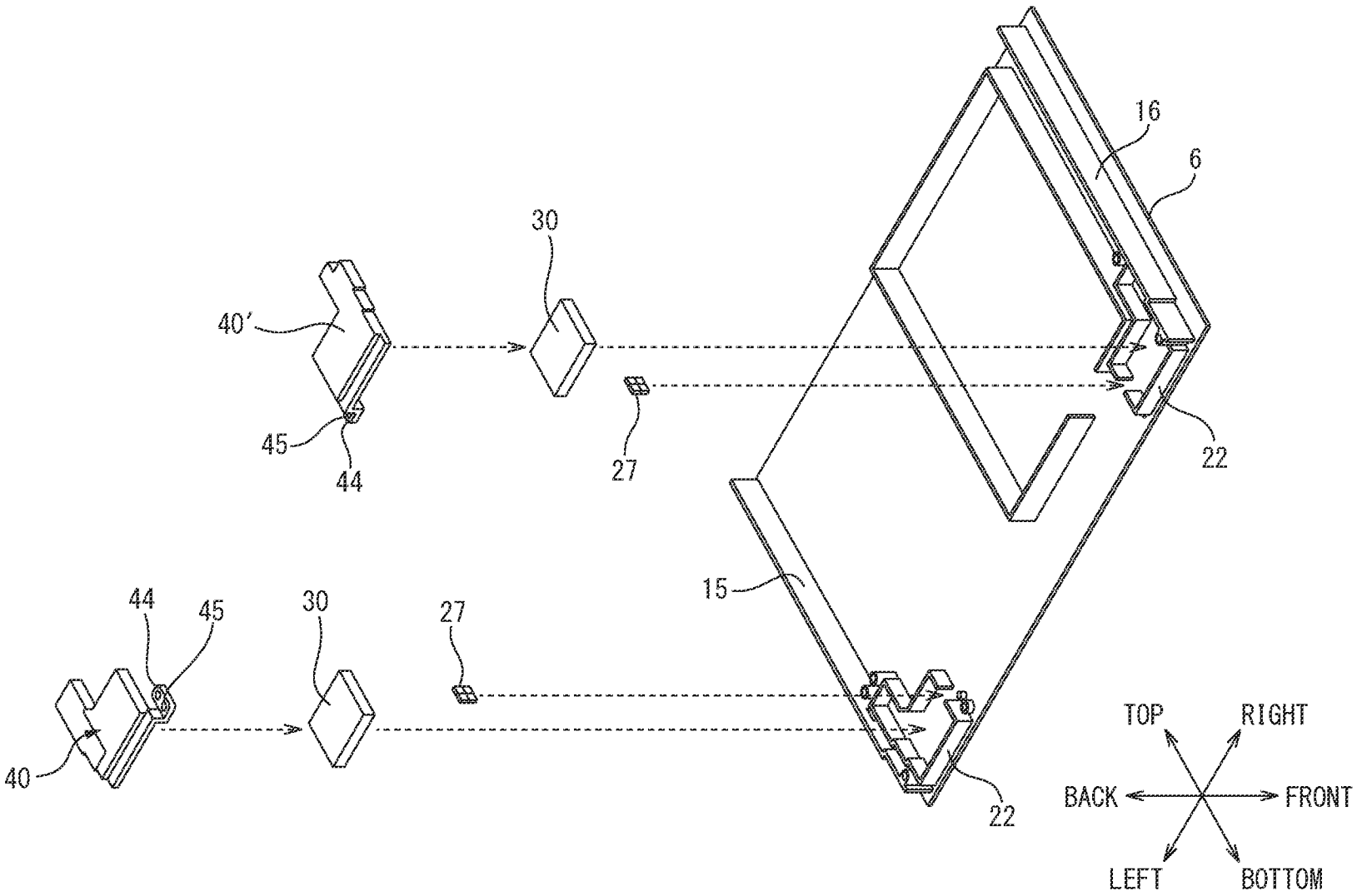
FIG. 7 is a perspective view of a front wall member, seen from the bottom right back.

FIG. 7 is a perspective view of the front wall member 6, seen from the bottom right back. FIG. 7 shows the speakers 30 attached to the front wall member 6 and the cover members 40. Further, FIG. 8 is an enlarged perspective view of a bottom left region of the front wall member 6, seen from the back.

Figure 8:
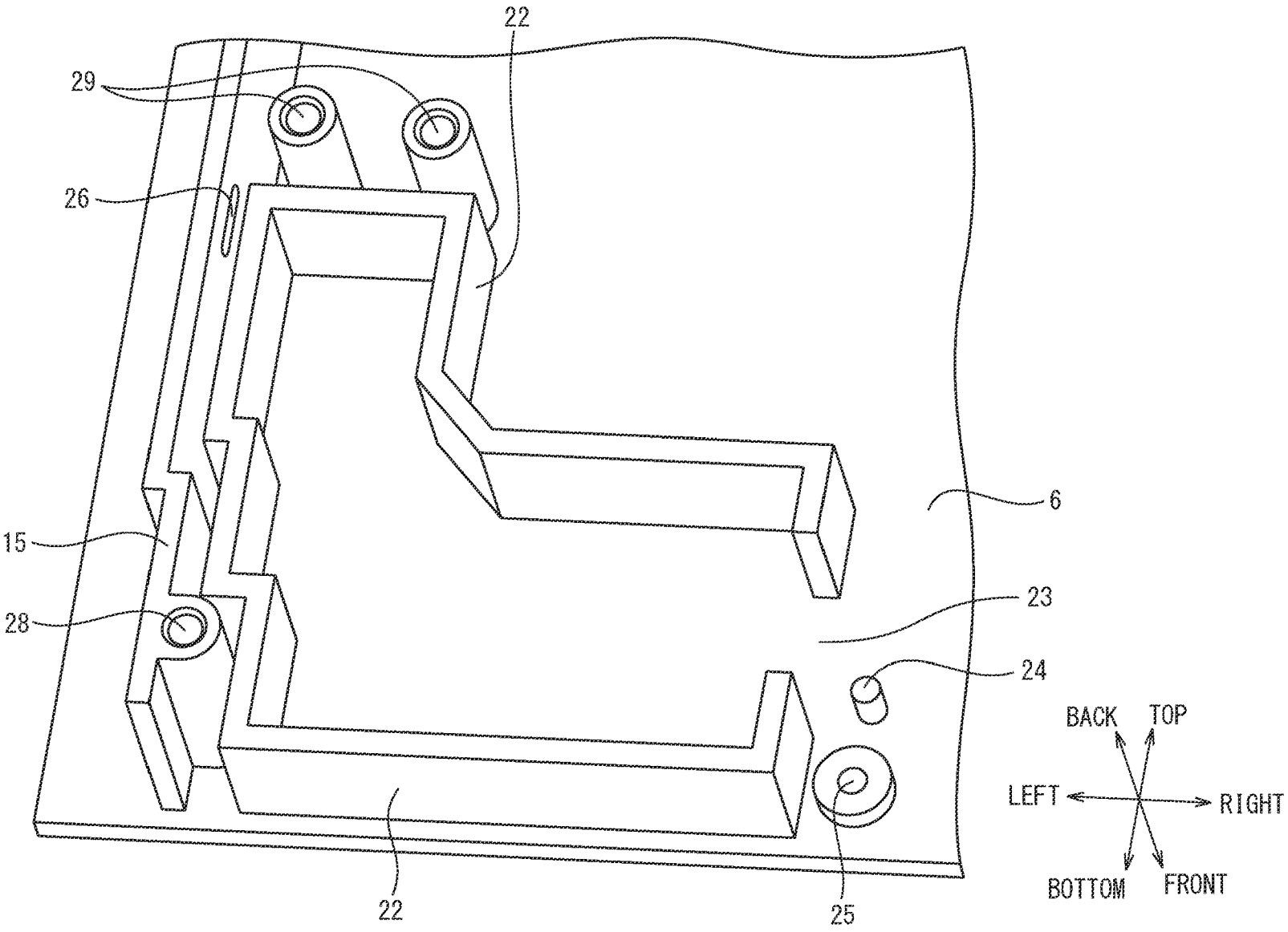
FIG. 8 is an enlarged perspective view of a bottom left region of the front wall member, seen from the back.

The loop-shaped ribs 22, as shown in FIGS. 6 to 8, are provided at the bottom left region and the bottom right region of the front wall member 6, and extend from the inside surface of the front wall 11 toward the back. As shown in FIG. 8, the loop-shaped ribs 22, when viewed from the back, are formed so as to surround, over substantially one circumference, the spaces of the shapes obtained by partially removing single edge parts of the rectangles. In the present embodiment, the loop-shaped ribs 22 are formed so as to surround L-shaped spaces when viewed from the back. Note that, "L-shaped spaces" are not limited to strictly L-shapes, and include substantially L-shapes.

Further, parts of the loop-shaped ribs 22, as shown in FIG. 6, extend along the bottom wall 14. In addition, other parts of the loop-shaped ribs 22 extend along the left wall 15 (or the right wall 16). In particular, in the present embodiment, the loop-shaped ribs 22 are formed so that the L-shaped spaces surrounded by the loop-shaped ribs 22 extend along the edge formed by the bottom wall 14 and left wall 15 (or the bottom wall 14 and right wall 16). In other words, in the present embodiment, in the spaces of the shapes obtained by partially removing single edge parts of the rectangles formed inside the loop-shaped ribs 22, parts of the loop-shaped ribs 22 corresponding to the two sides not adjoining the partially removed edge parts extend along the bottom wall 14 and left wall 15 (or right wall 16). Therefore, in the present embodiment, the loop-shaped ribs 22 are formed so that the edge parts positioned diagonally from the partially removed edge parts are positioned at the edge parts of the housing 2, in the spaces of the shapes obtained by partially removing single edge parts of the rectangles formed inside the loop-shaped ribs 22.

Note that, in the present embodiment, the loop-shaped ribs 22 are formed so as to surround the substantially L-shaped spaces when viewed from the back. However, the loop-shaped ribs 22 may be formed so as to surround the spaces of other shapes when seen from the back. Therefore, the loop-shaped ribs 22, for example, may be formed to surround spaces of substantially square shapes or substantially right triangular shapes when viewed from the back. Alternatively, the loop-shaped ribs 22 may be formed so as to surround the spaces of shapes, different from L-shapes, obtained by partially removing single edge parts of rectangles when seen from the back. Specifically, for example, the loop-shaped ribs 22 may be formed so as to surround spaces of substantially trapezoidal shapes or shapes of combinations of trapezoidal shapes and rectangular shapes etc.

In the present embodiment, the loop-shaped ribs 22 are formed so that the heights from the inside surface of the front wall 11 to the back are basically uniform over the entire circumferences. However, they may be partially notched as well so long as substantially surrounding the spaces. For example, in the present embodiment, as shown in FIG. 8, the loop-shaped ribs 22 only partially have notched parts 23 where the heights is lower.

Further, the front wall member 6, as shown in FIG. 8, has first screw holes 25 and cylindrically shaped projections 24 at the right side of the loop-shaped rib 22 provided at the bottom left region. A first screw hole 25 is arranged at the bottom right side of the loop-shaped rib 22 provided at the bottom left region. Therefore, the first screw hole 25 is arranged adjoining the bottom wall 14. Further, a projection 24 is arranged above the first screw hole 25, and extends toward the back. Similarly, the front wall member 6 has a screw hole (not shown) at the left side of the loop-shaped rib 22 provided at the bottom right region. This screw hole, like the first screw hole 25 provided at the bottom left region, is arranged at the bottom left side of the loop-shaped rib 22 provided at the bottom right region. Therefore, this screw hole is also arranged adjoining the bottom wall 14.

Furthermore, the front wall member 6, as shown in FIG. 8, has a left wall 15 at the left side of the loop-shaped rib 22 provided at the bottom left region. The left wall 15 is arranged near the loop-shaped rib 22 provided at the bottom left region, extends from the front wall 11 toward the back, and extends in the top-bottom direction. The left wall 15 is formed with a tab opening 26 near the top end of the loop-shaped rib 22. In the present embodiment, the tab opening 26 is formed so as to pass through the left wall 15, but the tab opening 26 may be a recessed part formed at the inside surface of the left wall 15 and not passing through the left wall 15. Similarly, the front wall member 6 has a right wall 16 at the right side of the loop-shaped rib 22 provided at the bottom right region (see later explained FIG. 17). The right wall 16 is arranged near the loop-shaped rib 22 provided at the bottom right region, extends from the front wall 11 toward the back, and extends in the top-bottom direction. The right wall 16 is formed with a tab opening 26 near the top end of the loop-shaped rib 22. The tab opening 26 of the right wall 16 may be a recessed part not passing through the right wall 16.

Speakers

Figure 9:
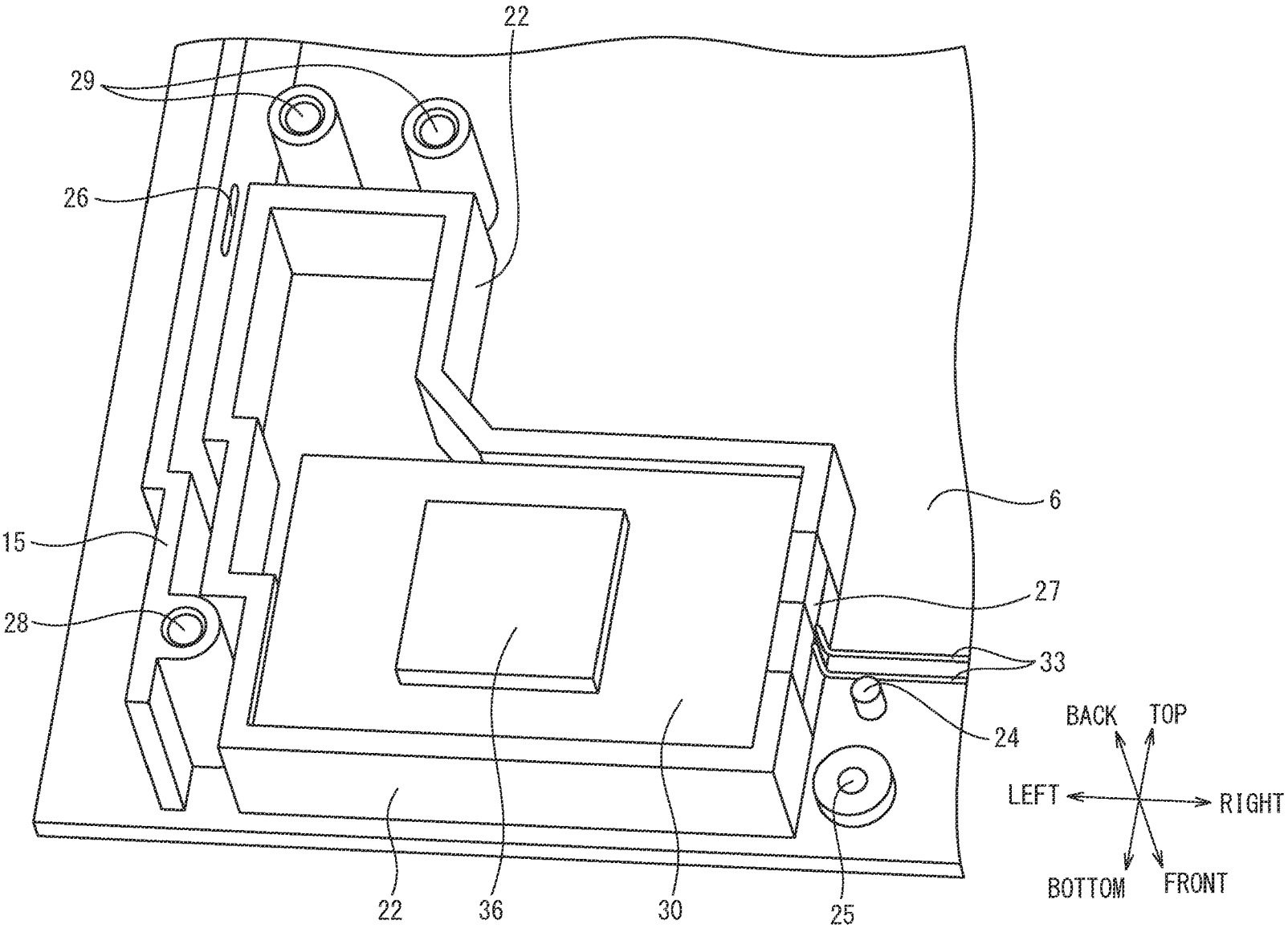
FIG. 9 is an enlarged perspective view, similar to FIG. 8, of a bottom left region of the front wall member where a speaker is provided, seen from the back.

FIG. 9 is an enlarged perspective view, similar to FIG. 8, of the bottom left region of the front member 6 where a speaker 30 is provided, seen from the back.

As shown in FIGS. 6, 7, and 9, the speakers 30 are arranged at the back of the front wall member 6 inside the loop-shaped ribs 22. The speakers 30 have vibration plates 31 for making the surrounding air vibrate, and main body parts 32 having mechanisms (for example, coils) for making the vibration plates 31 vibrate. The vibration plates 31 are arranged at the front parts of the speakers 30, and are held at their outer circumferences by the main body parts 32. Wires 33 are connected to the main body parts 32 of the speakers 30, and are, for example, connected to a circuit board housed in the housing 2. The main body parts 32 make the vibration plates 31 vibrate to generate sound when an electric signal is supplied to them through the wires 33.

As shown in FIG. 9, in the present embodiment, the speakers 30 are arranged at the bottom parts of the spaces formed inside the loop-shaped ribs 22. In particular, in the present embodiment, the main body parts 32 of the speakers 30 are formed into substantially cuboid shapes, and extend over substantially the entire parts extending in the lateral direction in the L-shaped spaces surrounded by the loop-shaped ribs 22.

As shown in FIG. 6, loop-shaped first cushion members 35 having elasticity are provided between the front surfaces of the main body parts 32 positioned at the outer circumferences of the vibration plates 31 of the speakers 30, and the back surfaces of the front wall 11 and front bottom transition wall 18 of the front wall member 6. In particular, in the present embodiment, the first cushion members 35 are arranged along the outer circumferences of the front surfaces of the main body parts 32 so as to surround the vibration plates 31. Further, in the present embodiment, the first cushion members 35 are adhered to front surfaces of the main body parts 32 of the speakers 30 and the back surfaces of the front wall 11 and front bottom transition wall 18 of the front wall member 6. The thus provided first cushion members 35 seal the spaces between the front surfaces of the main body parts 32 and the back surfaces of the front wall 11 and front bottom transition wall 18, if the speakers 30 are pushed toward the front. Further, the loop-shaped first cushion members 35 are arranged so that the inside ends of the speaker holes 21 are positioned inside of them. For this reason, the spaces between the front surfaces of the vibration plates 31 and the back surfaces of the front wall 11 and front bottom transition wall 18 are sealed other than at the speaker holes 21. In other words, the speaker holes 21 run from the outside of the housing 2 to the front surfaces of the vibration plates 31 of the speakers 30.

The first cushion members 35 are, for example, formed by a plastic having elasticity. Further, the first cushion members 35 are coated with an adhesive at their both surfaces, or have double-sided tapes having adhesive forces adhered to their both surfaces. Alternatively, the first cushion members 35 themselves may be formed as double-sided tapes having adhesive forces at their both surfaces. At least one of the surfaces of the first cushion members 35 may be weakly adhered to the front wall member 6 or speakers 30 to enable detachment.

Further, as shown in FIGS. 6 and 9, second cushion members 36 are provided at the back of the speakers 30. In particular, in the present embodiment, the second cushion members 36 are arranged at the back center of the speakers 30 and, further, are formed as rectangular plate shapes. In addition, in the present embodiment, the second cushion members 36 are formed so that the back surfaces of the second cushion members 36 stick out to the back further than the back surfaces of the loop-shaped ribs 22, when the second cushion members 36 are arranged at the back of the speakers 30. Furthermore, in the present embodiment, the second cushion members 36 are adhered to the back surfaces of the speakers 30.

The second cushion members 36 are, for example, formed by a plastic having elasticity. Further, the second cushion members 36 are, at the speaker 30 side, coated with an adhesive at their surfaces or adhered to double-sided tapes having adhesive forces one their both surfaces. Alternatively, the second cushion members 36 themselves may be formed as tapes having adhesive forces at single surfaces.

Further, as shown in FIG. 9, the notched parts 23 of the loop-shaped ribs 22 are provided with closing members 27 so as to close the notched parts 23. In particular, the closing members 27 are attached to the loop-shaped ribs 22 so that the loop-shaped ribs 22 and the closing members 27 are sealed to each other. The closing members 27 are formed so that their back ends are flush with the back ends of the loop-shaped ribs 22. Further, the closing members 27 are formed by rubber or other materials having elasticity. In addition, the closing members 27 have openings slightly smaller than the cross-sections of wires 33 so that wires 33 can pass through them. The wires 33 extend through these openings from the insides to the outsides of the loop-shaped ribs 22. The openings of the closing members 27 are smaller than the cross-sections of the wires 33, therefore the closing members 27 and the wires 33 are sealed to each other.

Cover Members

Figure 10:
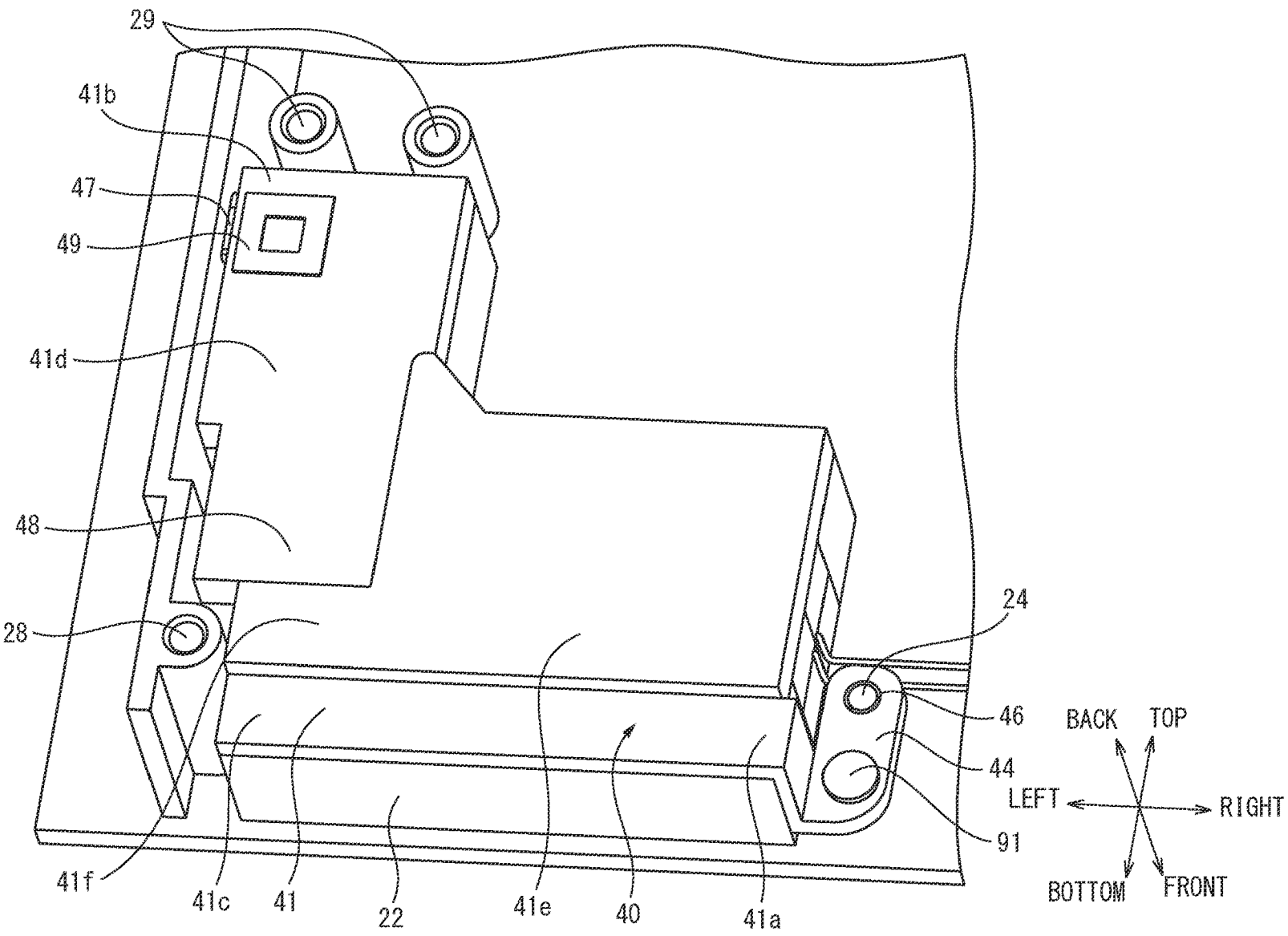
FIG. 10 is an enlarged perspective view, similar to FIG. 8, of the bottom left region of the front wall member where a cover member is attached, seen from the back.
Figure 11:
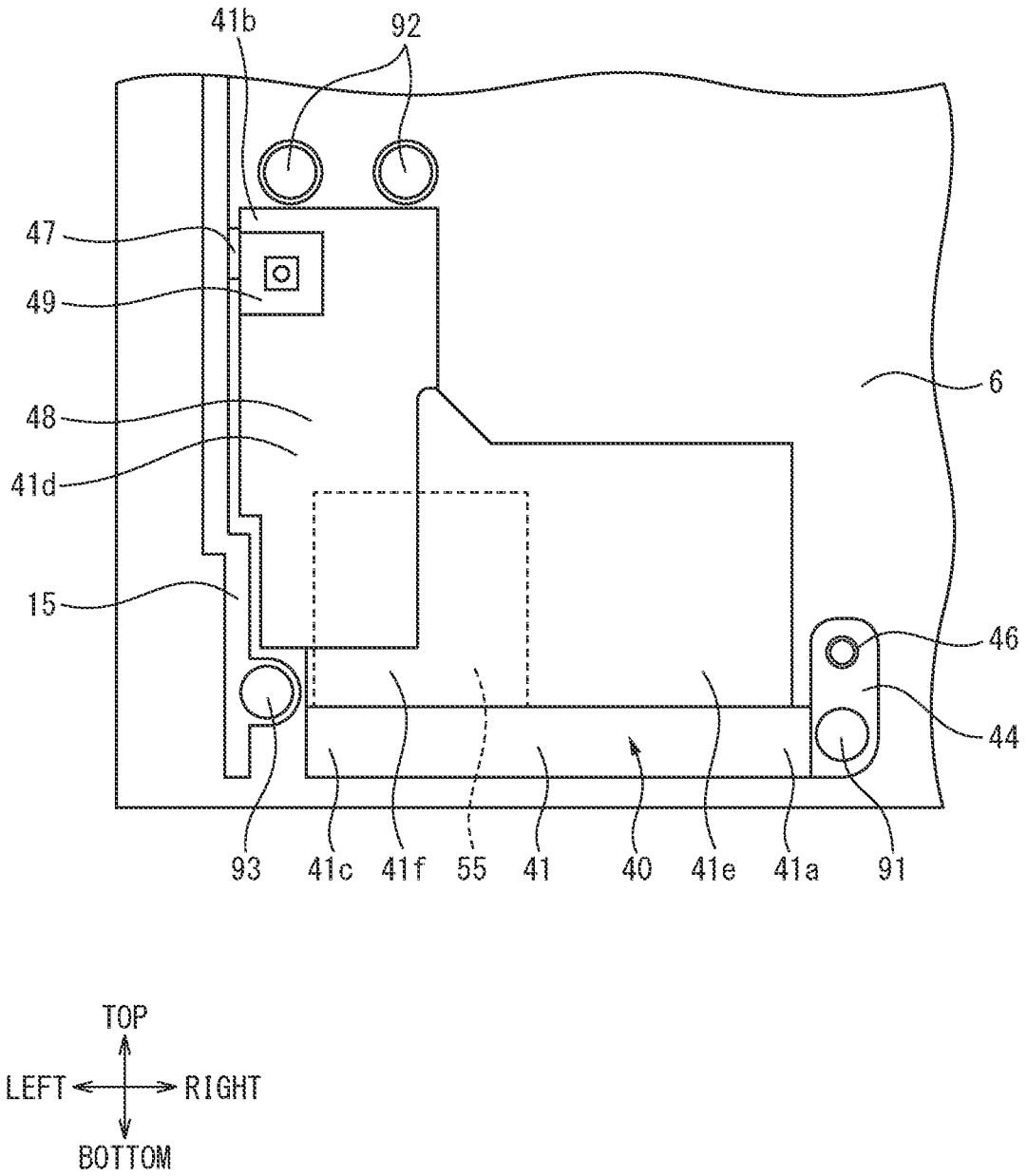
FIG. 11 is a back view of the bottom left region of the front wall member where the cover member is attached.
Figure 12:
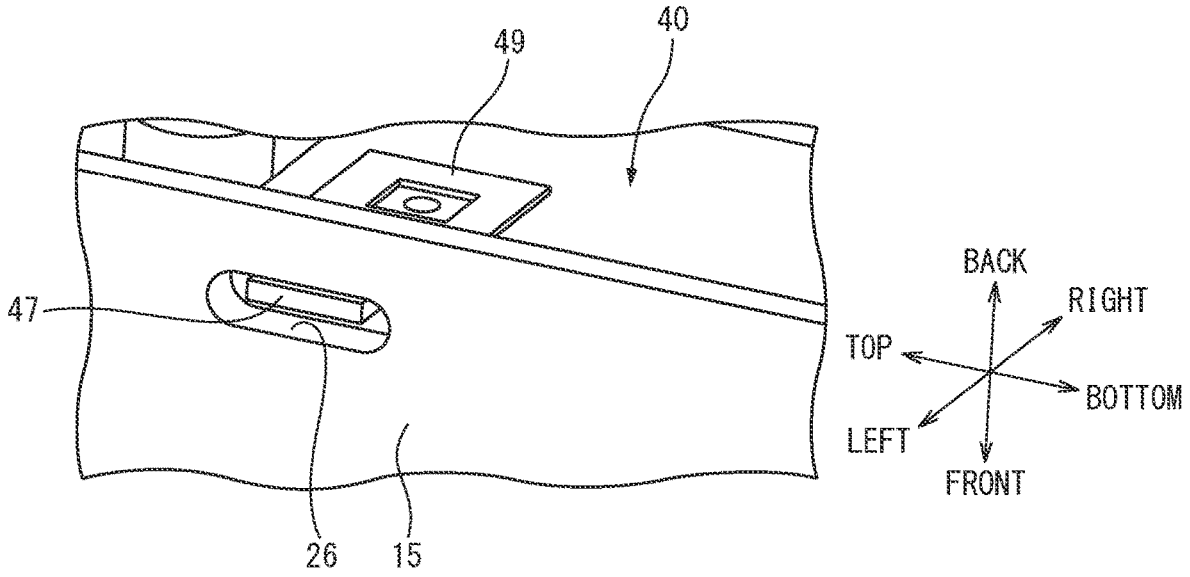
FIG. 12 is an enlarged perspective view of a left wall and the cover member in a vicinity of a tab opening.
Figure 13:
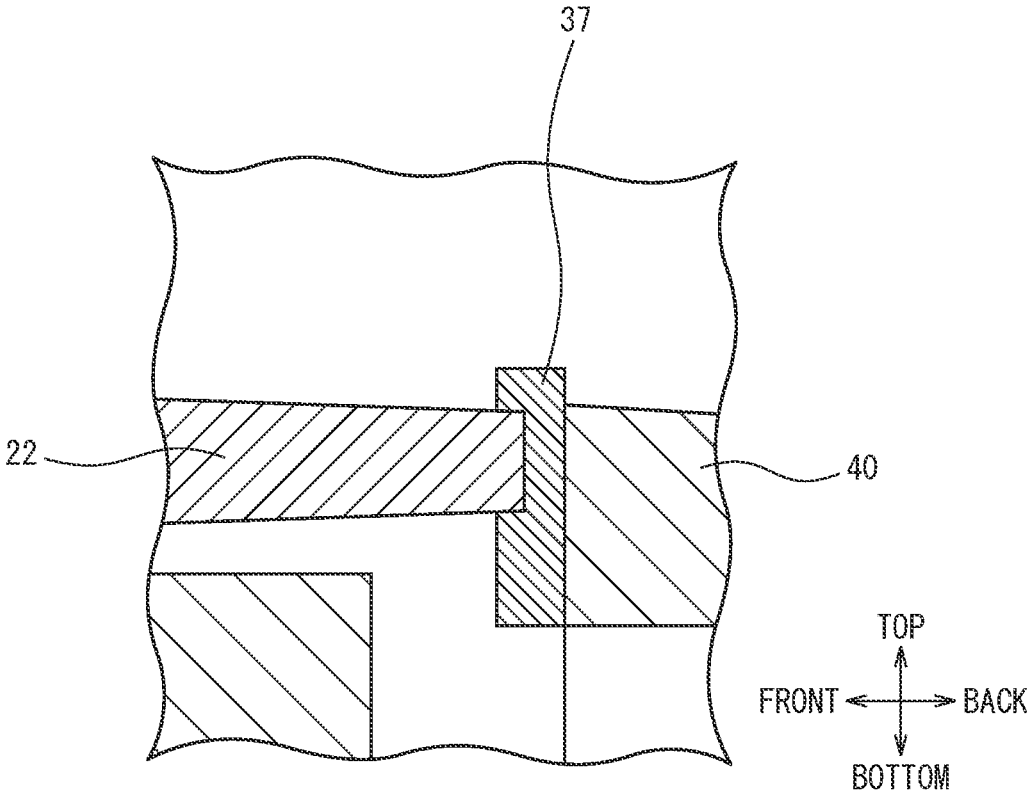
FIG. 13 is an enlarged view of a region surrounded by a square XIII of FIG. 6.

FIG. 10 is an enlarged perspective view, similar to FIG. 8, of the bottom left region of the front wall member 6 where a cover member 40 is attached, seen from the back. FIG. 11 is a back view of the bottom left region of the front wall member 6 where the cover member 40 is attached. FIG. 12 is an enlarged perspective view of a left wall 15 and the cover member 40 in a vicinity of a tab opening 26. FIG. 13 is an enlarged view of a region surrounded by a square XIII of FIG. 6.

As shown in FIGS. 6 and 10, the cover members 40 are detachably attached to the front wall member 6. In the present embodiment, the cover members 40 are detachably attached to the back ends of the loop-shaped ribs 22 so as to cover the spaces surrounded by the loop-shaped ribs 22. Therefore, the speakers 30 are arranged between the front wall member 6 and the cover members 40.

Further, the cover members 40 are formed by a relatively hard plastic. In the present embodiment, the cover members 40 are formed by a plastic harder than the back wall member 7 (for example, polycarbonate). Note that, the cover members 40 may be formed by a metal material or other material other than a plastic so long as formed by a relatively hard material.

The cover members 40 have ceiling parts 41 having outside shapes similar to the back ends of the loop-shaped ribs 22. Specifically, the ceiling parts 41 substantially have shapes obtained by partial removal of single edge parts of the rectangles, in the same way as the back ends of the loop-shaped ribs 22. In particular, in the present embodiment, the cover members 40 have substantially L-shaped ceiling parts 41.

Note that, the ceiling parts 41 of the cover members 40 may be formed so as to have other shapes as well. In particular, the cover members 40 have outside shapes of the same shapes as the back ends of the loop-shaped ribs 22. Therefore, when the loop-shaped ribs 22 are formed so as to surround substantially square spaces, the cover members 40 are formed so as to have substantially square outside shapes.

Further, in the present embodiment, the cover members 40 are attached to the front wall member 6 so that third edge parts 41*c* positioned diagonally from the partial removed edge parts when assuming the ceiling parts 41 are rectangular shapes (below, simply referred to as the "partially removed edge parts") are positioned at an edge part of the housing 2. Therefore, the cover member 40 attached to the bottom left region of the front wall member 6 is attached to the front wall member 6 so that the third edge part 41*c* is positioned at the edge part of the housing 2 defined by the left wall 15 and the bottom wall 14. Further, the cover member 40 attached to the bottom right region of the front wall member 6 is attached to the front wall member 6 so that the third edge part 41*c* is positioned at the edge part of the housing 2 defined by the right wall 16 and the bottom wall 14 (see FIG. 17).

As shown in FIGS. 10 and 11, near the first edge parts 41*a* among the two edge parts 41*a* and 41*b* adjoining the partially removed edge parts, fastening parts 44 are provided for positioning and fastening the cover members 40 at the front wall member 6. The fastening parts 44 are joined with the ceiling parts 41 so as to be parallel to the ceiling parts 41 and offset to the front from the ceiling parts 41. The fastening parts 44 have screw openings 45 for passing screws used for fastening the cover members 40 (see FIG. 7) and positioning-use openings 46 through which positioning-use projections 24 are passed. When the cover members 40 are being attached to the front wall member 6, in the state where the projections 24 of the front wall member 6 are arranged inside the positioning-use openings 46, the first screws 91 are passed through the screw openings 45 and screwed into the first screw holes 25 of the front wall member 6. Due to this, the fastening parts 44 are fastened to the front wall member 6 and accordingly the first edge parts 41*a* of the cover members 40 are fastened to the front wall member 6.

Further, as shown in FIGS. 10 to 12, near the second edge parts 41*b* among the two edge parts 41*a* and 41*b* adjoining the partially removed edge parts, tabs 47 extending from the ceiling parts 41 toward the outside of the ceiling parts 41 are provided. In the present embodiment, at the cover member 40 attached to the bottom left region of the front wall member 6, the tab 47 extends from the ceiling part 41 to the left. On the other hand, at the cover member 40 attached to the bottom right region of the front wall member 6, the tab 47 extends from the ceiling part 41 to the right (see FIG. 17). In addition, the tabs 47 are formed to have cross-sections being smaller than the cross-sections of the tab openings 26. In particular, the tabs 47 are formed to have cross-sectional shapes complementary with the cross-sectional shapes of the tab openings 26. When the cover members 40 are being attached to the front wall member 6, the tabs 47 are inserted into the tab openings 26. Further, if the fastening parts 44 of the cover members 40 are fastened to the front wall member 6 by the first screws 91, the tabs 47 will no longer pull out from the tab openings 26, and accordingly the second edge parts 41*b* of the cover members 40 will be fastened to the front wall member 6.

Therefore, in the present embodiment, the cover members 40 are fastened to the front wall member 6 at the two edge parts 41*a* and 41*b* adjoining the partially removed edge parts. In particular, in the present embodiment, one of the two edge part 41*a* and 41*b* is fastened to the front wall member 6 by the tab 47, therefore only single edge parts of the cover members 40 are fastened by the first screws 91. Therefore, the locations fastened by screws with their large required spaces can be kept to a minimum, while the cover members 40 can be fastened to the front wall member 6 at a plurality of locations.

Changing the viewpoint, in the present embodiment, the ceiling parts 41 are L-shapes having first parts 41*d* extending in a first direction (for example, the top-bottom direction) and second parts 41*e* extending in a second direction perpendicular to the first direction (for example, the left-right direction), and are attached to the front wall member 6 so that parts 41*f* where the first parts 41*d* and the second parts 41*e* cross are positioned at the edge parts of the housing 2. Therefore, the cover member 40 attached to the bottom left region of the front wall member 6 is attached to the front wall member 6 so that the crossing part 41*f* is positioned at an edge part of the housing 2 defined by the left wall 15 and the bottom wall 14. Further, the cover member 40 attached to the bottom right region of the front wall member 6 is attached to the front wall member 6 so that the crossing part 41*f* is positioned at an edge part of the housing 2 defined by the right wall 16 and the bottom wall 14 (see FIG. 17).

Further, the end parts of the second parts 41*e* at the opposite side to the crossing parts 41*f* are provided with fastening parts 44 having screw openings 45 and positioning-use openings 46. In addition, the end parts of the first parts 41*d* at the opposite side to the crossing parts 41*f* are provided with tabs 47. Therefore, in the present embodiment, the cover members 40 are fastened to the front wall member 6 at the end parts of the first parts 41*d* at the opposite side to the crossing parts 41*f* and the end parts of the second parts 41*e* at the opposite side to the crossing parts 41*f*. Note that, the end parts of the first parts 41*d* at the opposite side to the crossing parts 41*f* may be provided with the fastening parts 44, and the end parts of the second parts 41*e* at the opposite side to the crossing parts 41*f* may be provided with the tabs 47.

Note that, the cover members 40 need not necessarily be fastened near the first edge parts 41*a* and the second edge parts 41*b*. Therefore, the cover members 40 may be fastened to the front wall member 6 at two different locations of the outer circumferential parts of the cover members 40, for example, near the first edge parts 41*a* and near the edge parts 41*c* positioned diagonally from the partially removed edge parts. Further, the cover members 40 need not necessarily be fastened at the two edge parts by the tabs 47 and the first screws 91. Both may be fastened by screws or both may be fastened by tabs. Alternatively, the cover members 40 may be fastened to the front wall member 6 at single locations or pluralities of locations of greater than or equal to three locations.

As shown in FIG. 6, the front surfaces of the ceiling parts 41 of the cover members 40 are provided with cover ribs 50 extending to the front. In the present embodiment, the cover ribs 50 are formed to have cross shapes when viewed from the front, and are arranged so as to be positioned at the centers of the ceiling parts 41. Therefore, the cover ribs 50 are arranged so as to overlap the second cushion members 36 arranged on the back surfaces of the speakers 30 when viewed from the back, when the cover members 40 are attached to the front wall member 6.

The cover ribs 50 are formed so that the clearances between their front ends and the back surfaces of the speakers 30 is smaller than the thicknesses of the second cushion members 36, when the cover members 40 are attached to the front wall member 6. Therefore, the cover ribs 50 are pushed to the front into the second cushion members 36 when the cover members 40 are attached to the front wall member 6.

If the cover ribs 50 are pushed into the second cushion members 36 in this way, the speakers 30 are pushed to the front by the second cushion members 36, and the speakers 30 are pushed against the first cushion members 35. As a result, the speakers 30 are supported by the first cushion members 35 and the second cushion members 36. By the speakers 30 being supported by the cushion members 35 and 36 in this way, the speakers 30 can be prevented from directly contacting hard members and generating miscellaneous sounds.

Note that, in the present embodiment, the second cushion members 36 are adhered to the speakers 30. However, the second cushion members 36 may be adhered to the cover members 40. In this case, ribs similar to the cover ribs 50 may be provided in the speaker 30 sides.

Further, as shown in FIGS. 6 and 13, third cushion members 37 having elasticity are arranged between the back end surfaces of the loop-shaped ribs 22 (end surface of front wall member 6 at cover member 40 side) and the front end surfaces of the cover members 40 (end surfaces of cover members 40 at front wall member 6 side). The third cushion members 37 are examples of the second elastic members arranged between the cover members 40 and front wall member 6. The third cushion members 37 have loop-shapes similar to the back end surfaces of the loop-shaped ribs 22 and the outer circumferences of the cover members 40. The third cushion members 37, for example, are formed by a plastic having elasticity.

In particular, in the present embodiment, the third cushion members 37 are weakly adhered to the front wall member 6 and cover members 40, specifically are weakly adhered to the back end surfaces of the loop-shaped ribs 22 and the front end surfaces of the cover members 40. In the present embodiment, the third cushion members 37 have double-sided tapes having adhesive forces at their both surfaces or have an adhesive coated on them so as to weakly adhere them to the front wall member 6 and cover members 40. Alternatively, the third cushion members 37 themselves may be formed as double-sided tapes having adhesive forces at the both surfaces.

Since the third cushion members 37 are weakly adhered to the front wall member 6 and cover members 40 in this way, the front wall member 6 and the cover members 40 can be easily detached from each other. By the front wall member 6 and the cover members 40 being detachably adhered in this way, the work of replacing speakers 30 is easy. Note that, the third cushion members 37 may be weakly adhered with only one of the front wall member 6 and cover members 40, and strongly adhered with the other so as not to be detached. Whatever the case, the front wall member 6 and the cover members 40 are detachably adhered by the third cushion members 37 from each other.

Further, the third cushion members 37 are formed so as to have thicknesses (for example, 0.2 mm) larger than the clearances between the cover members 40 and the front wall member 6 when the cover members 40 are fastened to the front wall member 6 (that is, the clearances between the front end surfaces of the cover members 40 and the back end surfaces of the loop-shaped ribs 22, for example, 0.1 mm). Further, as shown in FIG. 13, the surfaces of the third cushion members 37 contacting the loop-shaped ribs 22 are broader than the abutting surfaces of the loop-shaped ribs 22 with the third cushion members 37 (that is, the back end surfaces of the loop-shaped ribs 22), over the entire circumferences of the loop-shaped third cushion members 37.

Therefore, in the present embodiment, when the cover members 40 are fastened to the front wall member 6, the third cushion members 37 are pressed by the front end surfaces of the cover members 40 and the back end surfaces of the loop-shaped ribs 22. Since the third cushion members 37 are compressed and adhered with the back end surfaces of the loop-shaped ribs 22 and the front end surfaces of the cover members 40 in this way, the loop-shaped ribs 22 and the cover members 40 are sealed to each other, that is, the front wall member 6 and the cover members 40 are sealed to each other. Further, in the present embodiment, the surfaces of the third cushion members 37 contacting the loop-shaped ribs 22 are broader toward the outside and inside than the back end surfaces of the loop-shaped ribs 22. Further, the surfaces of the third cushion members 37 contacting the cover members 40 are broader toward the outside than the front end surfaces of the cover members 40. As a result, as shown in FIG. 13, the third cushion members 37 are formed so as to stick out from between the front end surfaces of the cover members 40 and the back end surfaces of the loop-shaped ribs 22. Due to this, the third cushion members 37 can more reliably seal the loop-shaped ribs 22 and the cover members 40 to each other.

Note that, the third cushion members 37 may be formed so that the surfaces of the third cushion members 37 contacting the loop-shaped ribs 22 are broader toward the outside and/or the inside than the back end surfaces of the loop-shaped ribs 22 across the entire circumferences of the loop-shaped third cushion members 37 or only part of the circumferential direction. Alternatively, the third cushion members 37 may be formed so that the surfaces of the third cushion members 37 contacting the cover members 40 are broader than the front end surfaces of the cover members 40 across the entire circumferences of the loop-shaped third cushion members 37 or only part of the circumferential direction. As a result, the third cushion members 37 are formed so as to stick out inward and/or outward between the end surfaces of the cover members 40 at the front wall member 6 sides and the end surface of the front wall member 6 at the cover member 40 side.

In this way, the loop-shaped ribs 22 and the cover members 40 are sealed to each other, that is, the front wall member 6 and the cover members 40 are sealed to each other, by the third cushion members 37. In addition, the back surfaces of the front wall 11 and front bottom transition wall 18 and the speakers 30 are sealed to each other, that is, the front wall member 6 and the speakers 30 are sealed to each other, by the first cushion members 35. As a result, closed spaces are defined by the back surfaces of the vibration plates 31 of the speakers 30, the front wall member 6, and the cover members 40. On the other hand, as explained above, the front surfaces of the vibration plates 31 of the speakers 30 define spaces opening through the speaker holes 21. Therefore, sound emitted from the front surfaces of the vibration plates 31 of the speakers 30 is kept from interfering with sound emitted from the back surfaces of the vibration plates 31 of the speakers 30 and a high sound quality can be realized.

Further, the cover member 40 attached to the bottom left region of the front wall member 6, as shown in FIGS. 10 and 11, has a recessed part 48 at its back surface. The recessed part 48 is depressed more to the front side than other regions at the back surface of the ceiling part 41 of the cover member 40 and, further, extends from the top left to the bottom left. On the recessed part 48, that is, on the back side of the recessed part 48, FPCs (Flexible Printed Circuits. not shown) are arranged for connecting the electronic components in the electronic device 1 with each other. In the present embodiment, the recessed part 48 is formed so as to be depressed by greater than or equal to the thickness of the FPC.

In addition, the cover members 40 have leak hole meshes 49. The leak hole meshes 49 are provided at parts of the ceiling parts 41 of the cover members 40. The leak hole meshes 49 are formed so as to pass air when there is a pressure difference between the two sides of the leak hole meshes 49, but basically not to pass sound. If the pressure in the closed spaces defined by the back surfaces of the vibration plates 31 of the speakers 30, the front wall member 6, and the cover members 40 rises, air in the closed spaces is discharged to the outside by the leak hole meshes 49. Accordingly, the pressure in the closed spaces is kept from rising and the sound quality is kept from falling.

Note that, in the present embodiment, the loop-shaped ribs 22 are formed at the front wall member 6, and the loop-shaped ribs 22 and cover members 40 are sealed to each other by the third cushion members 37. However, the loop-shaped ribs may be formed at the cover members 40. In this case, the loop-shaped ribs formed at the cover members 40 and the front wall member 6 not provided with the loop-shaped ribs are sealed to each other by cushion members. Alternatively, the loop-shaped ribs may be formed at both of the front wall member 6 and cover members 40. In this case, the loop-shaped ribs formed at the front wall member 6 and the loop-shaped ribs formed at the cover members 40 are sealed to each other by cushion members.

Circuit Board

Figure 14:
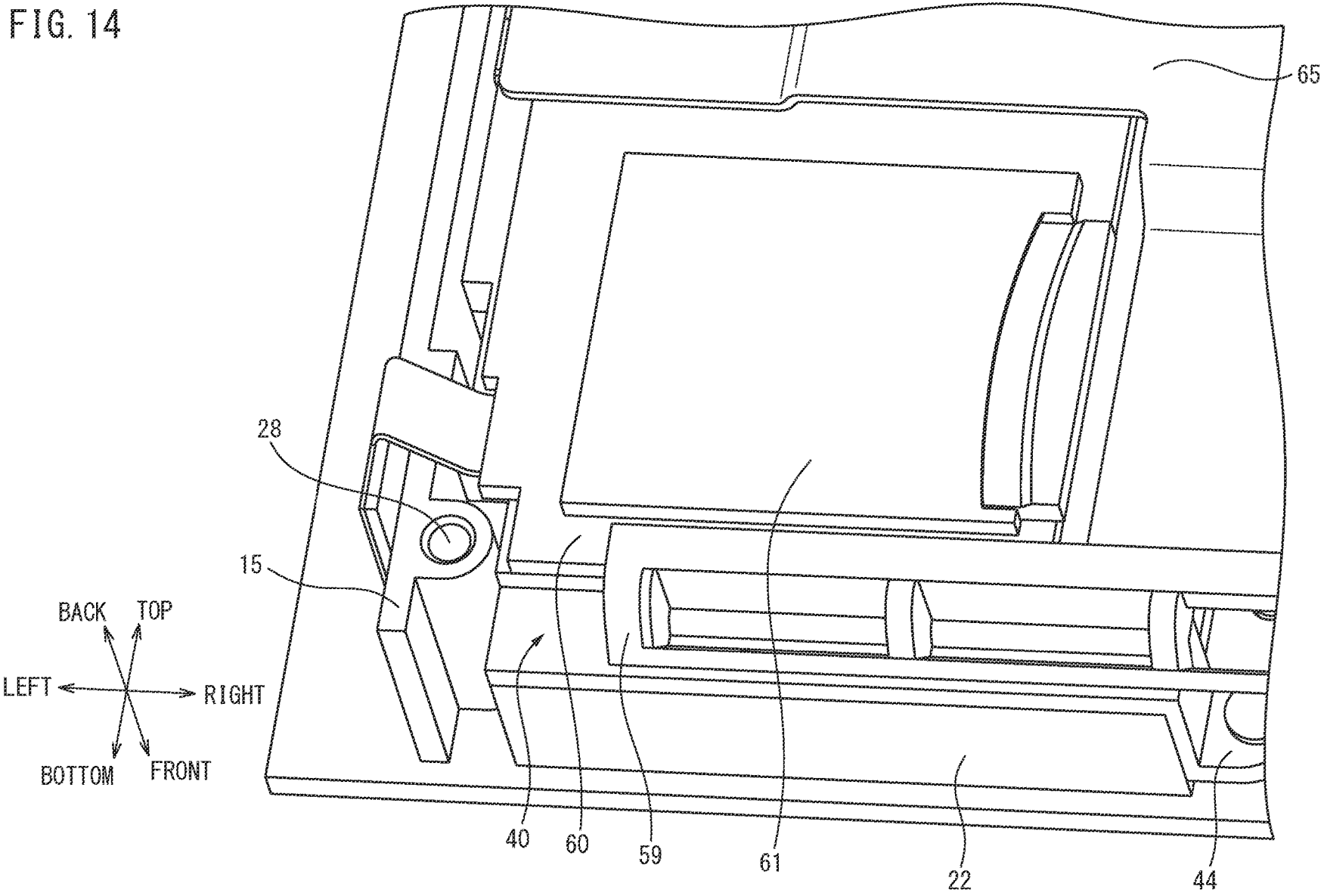
FIG. 14 is an enlarged perspective view, similar to FIG. 8, of the bottom left region of the front wall member in the state where a circuit board is attached at the back of the cover member, seen from the back.

FIG. 14 is an enlarged perspective view, similar to FIG. 8, of the bottom left region of the front wall member 6 in the state where a circuit board 60 is attached at the back of the cover member 40, seen from the back.

As shown in FIGS. 6 and 14, at the back of the cover member 40, a circuit board 60 is provided extending in parallel with the ceiling parts 41 of the cover members 40. In addition, at the back of the circuit board 60, a first metal plate 65 is provided. A plurality of electronic components mounted on the circuit board 60, and the circuit board 60 is connected to a plurality of electronic components of the electronic device 1 not mounted on the circuit board. The circuit board 60 is used for transmission of electric power or electric signals among the plurality of electronic components of the electronic device 1. Further, the first metal plate 65 is arranged so as to cover the circuit board 60 and other electronic components, and for example functions as a shield preventing entry of noise.

The circuit board 60 extends upward at the back of the cover members 40. Therefore, the circuit board 60 extends over the two second screw holes 29 (see FIG. 8, etc.) provided at the front wall member 6 above the loop-shaped ribs 22. The circuit board 60 has two openings (not shown) corresponding to the second screw holes 29 at regions positioned at the back of the second screw holes 29 when attached to the front wall member 6, and is fastened to the front wall member 6 by the second screws 92 being screwed into the second screw holes 29 through the openings (note that, FIG. 11 shows the state where the second screws 92 are screwed into the second screw holes 29 in the state where the circuit board 60 is not fastened). Further, the circuit board 60 is fastened to the front wall member 6 at a plurality of locations where the second screw holes 29 are arranged. The circuit board 60 is arranged at the back of the cover members 40, and is one example of a fastening member fastened to the housing 2.

Note that, in the present embodiment, the circuit board 60 is fastened to the front wall member 6, but it may be fastened to a member forming part of the housing 2 other than the front wall member 6. Therefore, the circuit board 60 may be fastened to the back wall member 7.

In the present embodiment, the circuit board 60 is equipped with a slot 61 into which a card type storage medium or other peripheral device may be loaded. The opening of the slot 61 for the storage medium is, as shown in FIG. 3, positioned at the opening 72 formed at the back wall member 7. Therefore, the opening of the slot 61 is exposed to the outside of the back wall member 7, therefore, to the outside of the housing 2. A peripheral device is loaded into the slot 61 from outside the housing 2, through the opening 72 provided at the back wall member 7.

Further, as shown in FIG. 6, fourth cushion members 55 are attached to the front surface of the circuit board 60. In the present embodiment, the fourth cushion members 55 are arranged between the cover members 40 and the circuit board 60. Therefore, the fourth cushion members 55 are examples of the first elastic members provided between the cover members 40 and the circuit board 60 (fastening member). The fourth cushion members 55 are, for example, formed by a plastic having elasticity.

Further, the fourth cushion members 55 are adhered to the front surface of the circuit board 60. In addition, in the present embodiment, the fourth cushion members 55 are not adhered to the back surfaces of the cover members 40. Specifically, the surfaces of the fourth cushion members 55 at the circuit board 60 sides have double-sided tapes having adhesive forces at their both surfaces or have an adhesive coated on them. The surfaces of the fourth cushion members 55 at the cover member 40 sides are not provided with double-sided tapes or adhesives. Alternatively, the fourth cushion members 55 themselves may be formed as tapes having adhesive forces at single surfaces.

In the present embodiment, the fourth cushion members 55 are formed into flat plate shapes. The fourth cushion members 55 have thicknesses substantially the same as the clearances formed between the back surfaces of the cover member 40 and the front surface of the circuit board 60, when the cover members 40 and the circuit board 60 are attached to the housing 2. Therefore, the fourth cushion members 55 are configured so as to contact the cover members 40 and the circuit board 60.

Further, the fourth cushion members 55, as shown by the broken lines in FIG. 11, are arranged so as to be positioned near the third edge parts 41*c* of the cover members 40 when the cover members 40 and the circuit board 60 are attached to the front wall member 6. Therefore, the fourth cushion members 55 are arranged so as to contact the cover members 40 at regions closer to the third edge parts 41*c* not fastened to the front wall member 6 than the first edge part 41*a* and the second edge part 41*b* fastened to the front wall member 6.

In this regard, the cover members 40 are fastened to the front wall member 6 near the first edge parts 41*a* and near the second edge parts 41*b*. The front wall member 6 is formed by a metal material and the cover members 40 are formed by a relatively hard plastic, therefore these are resistant to deformation, but even so there is a possibility of the cover members 40 or the front wall member 6 deforming and resulting in the state where the cover members 40 rise away from the front wall member 6 in regions near the third edge parts 41*c* where the cover members 40 are not fastened to the front wall member 6. If resulting in a state where the cover members 40 rise up in this way, the sealability between the cover members 40 and the front wall member 6, in particular between the cover members 40 and the loop-shaped ribs 22, is liable to fall. If the cover members 40 and loop-shaped ribs 22 are no longer sealed, sound is liable to leak out from the clearances formed between the cover members 40 and the loop-shaped ribs 22 and accordingly the acoustic performance of the electronic device 1 is liable to fall.

In the present embodiment, fourth cushion members 55 are provided near the third edge parts 41*c* between the cover members 40 and the circuit board 60 so as to contact the same, and the circuit board 60 is fastened to the housing 2. Therefore, even if the cover members 40 or the front wall member 6 tries to deform so that the cover members 40 rise up in the regions near the third edge parts 41*c*, the cover members 40 are kept from rising up due to the fourth cushion members 55. Therefore, the acoustic performance of the electronic device 1 is kept from falling due to deformation of the cover members 40.

In particular, in the present embodiment, to facilitate the work of replacement of a speaker 30, etc., the front wall member 6 and the cover members 40 are not attached by for example welding, etc., so as to be unable to be detached from each other, but are detachably adhered from each other. However, in the present embodiment, third cushion members 37 are provided between the front wall member 6 and the cover members 40 so as to form a tight seal between the front wall member 6 and the cover members 40. Accordingly, leakage of sound from between the front wall member 6 and the cover members 40 is suppressed. In addition, as explained above, the state where the cover members 40 rise up along with deformation of the front wall member 6 and cover members 40 is kept from occurring by the fourth cushion members 55. Therefore, according to the present embodiment, it is possible to secure work efficiency in replacement of a speaker 30, etc., while maintaining the sealability of the front wall member 6 and cover members 40, and accordingly possible to maintain the acoustic performance of the electronic device 1.

Note that, the fourth cushion members 55 may have any thickness so long as able to contact the cover members 40 and the circuit board 60. Therefore, the fourth cushion members 55 may have thicknesses greater than the clearances formed between the back surfaces of the cover members 40 and the front surface of the circuit board 60, when the cover members 40 and the circuit board 60 are attached to the housing 2. In this case, the fourth cushion members 55 constantly bias the cover members 40 toward the front.

Further, the fourth cushion members 55 need not necessarily be arranged near the third edge parts 41*c*. However, the fourth cushion members 55 need not be provided at the first edge parts 41*a* and the second edge parts 41*b*. This is because there is a low possibility of the cover members 40 rising up at the first edge parts 41*a* and the second edge parts 41*b* fastened to the front wall member 6. That is, the fourth cushion members 55 need not be arranged at the location where the cover members 40 are fastened to the front wall member 6.

Furthermore, a plurality of the fourth cushion members 55 may be provided between the cover members 40 and the circuit board 60. In this case, at least one of the fourth cushion members 55 may be provided near the third edge parts 41*c*.

Back Wall Member

As explained above, the back wall member 7 includes the back wall 12, and configures part of the housing 2. The back wall member 7 has an opening at a position corresponding to a third screw hole 28 provided at the bottom left of the front wall member 6 when attached to the front wall member 6. A third screw 93 is screwed into the third screw hole 28 through this opening whereby the back wall member 7 is fastened to the front wall member 6.

As shown in FIG. 6, the back wall member 7 has back wall ribs 71 extending from the front surface (inside surface) of the back wall 12 to the front and therefore extending toward the circuit board 60. The back wall ribs 71 are formed so that their heights in the front-back direction are slightly smaller than the interval between the front surface of the back wall 12 of the back wall member 7 and the back surface of the circuit board 60. Therefore, the front ends of the back wall ribs 71 do not contact the back surface of the circuit board 60, but are positioned right above the back surface of the circuit board 60.

Figure 15:
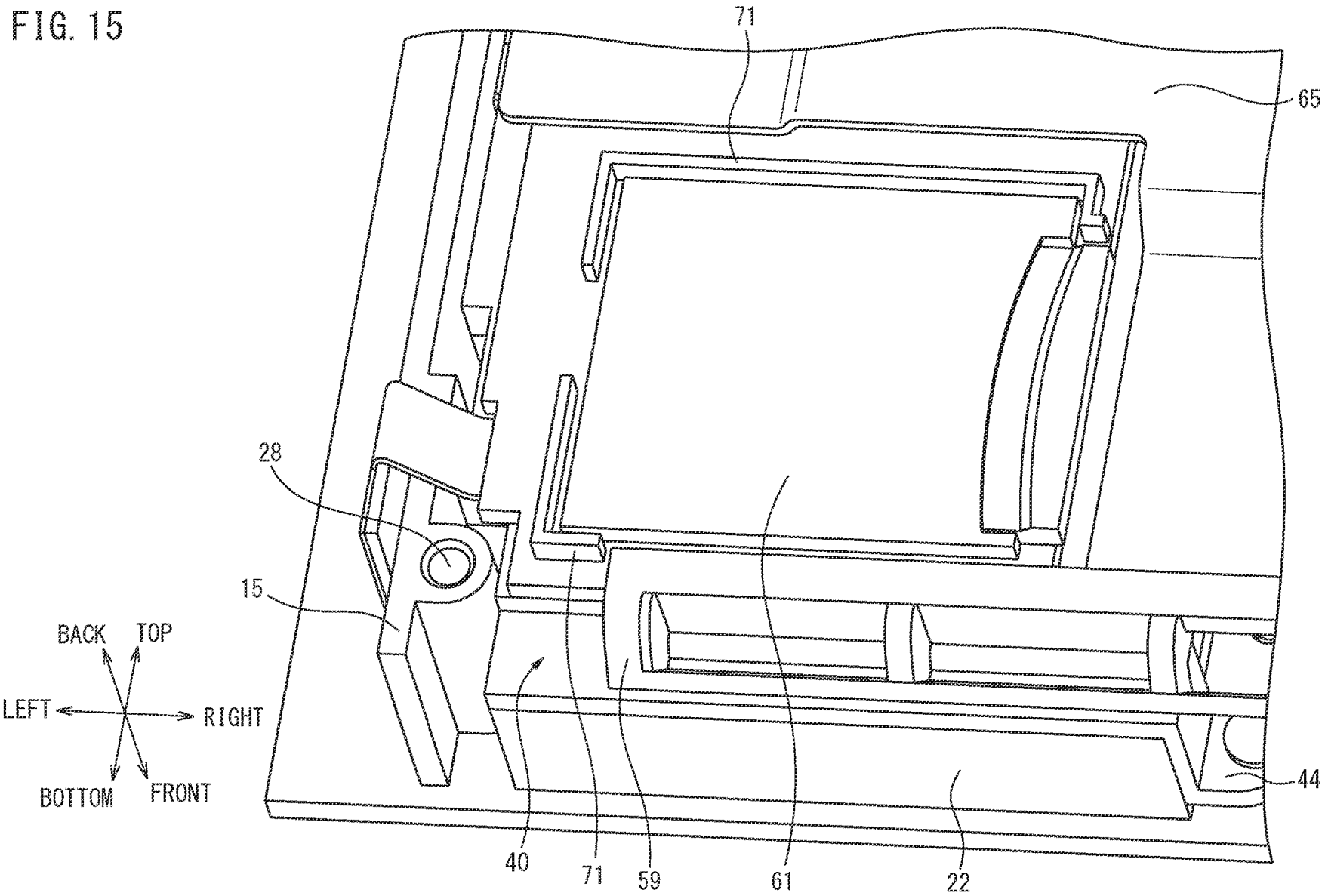
FIG. 15 is an enlarged perspective view, similar to FIG. 14, of the bottom left region of the front wall member in the state where the circuit board is attached at the back of the cover member, seen from the back.

FIG. 15 is an enlarged perspective view, similar to FIG. 14, of the bottom left region of the front wall member 6 in the state where the circuit board 60 is attached at the back of the cover members 40, as seen from the back. FIG. 15 does not illustrate the back wall 12 of the back wall member 7, but the back wall ribs 71 of the back wall member 7 are illustrated.

As will be understood from FIG. 15, the back wall ribs 71 are arranged around the slot 61 mounted on the circuit board 60. In particular, in the present embodiment, the back wall ribs 71 are arranged so as to partially surround the side surfaces other than the side surface where the inlet of the slot 61 is provided. As explained above, the back wall member 7 is provided with the opening 72 so as to allow access to the slot 61, but by providing the back wall ribs 71, it becomes harder for air flowing into the surroundings of the slot 61 through the opening 72 to flow into the housing 2 any further, and accordingly dust or the like are kept from entering into the housing 2.

Further, the back wall ribs 71 arranged at the back wall member 7 so as to face the circuit board 60 below the locations where the circuit board 60 is fastened to the front wall member 6 (that is, locations corresponding to the second screw holes 29). Therefore, the back wall ribs 71 are arranged so as to face the circuit board 60 at the fourth cushion member 55 side from the locations where the circuit board 60 is fastened to the front wall member 6. As a result, even if the circuit board 60 deforms through the fourth cushion members 55 due to deformation of the cover members 40, etc., the circuit board 60 will abut against the back wall ribs 71, and will be resistant to further deformation. Therefore, the circuit board 60 is kept from deforming by the back wall ribs 71, and along with that the cover members 40 are kept from deforming and in turn the acoustic performance of the electronic device 1 is kept from falling.

Configuration at Bottom Right Region

Figure 16:
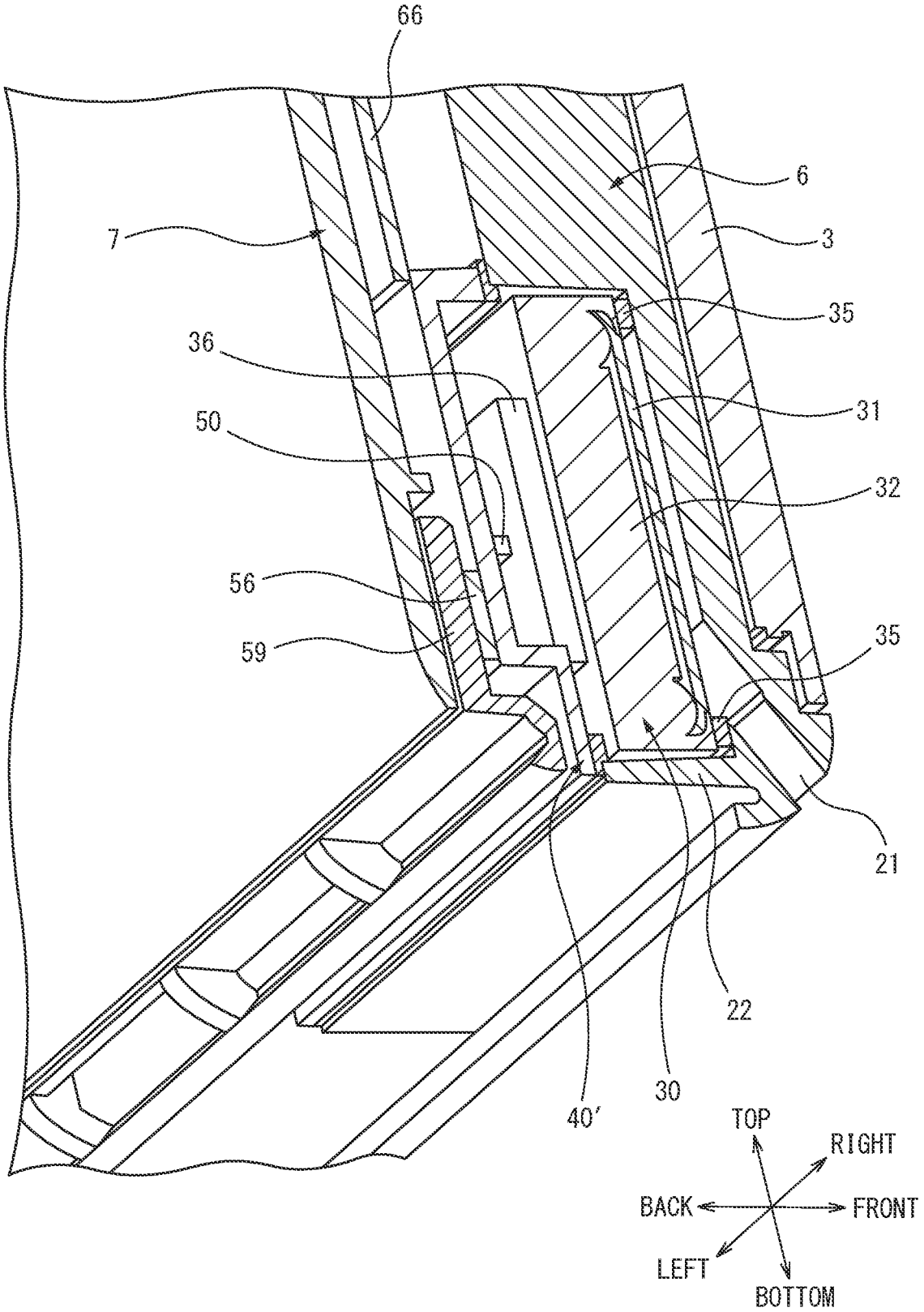
FIG. 16 is a cross-sectional perspective view of the bottom right region of the housing, seen along the line XVI-XVI of FIGS. 1 to 3.
Figure 17:
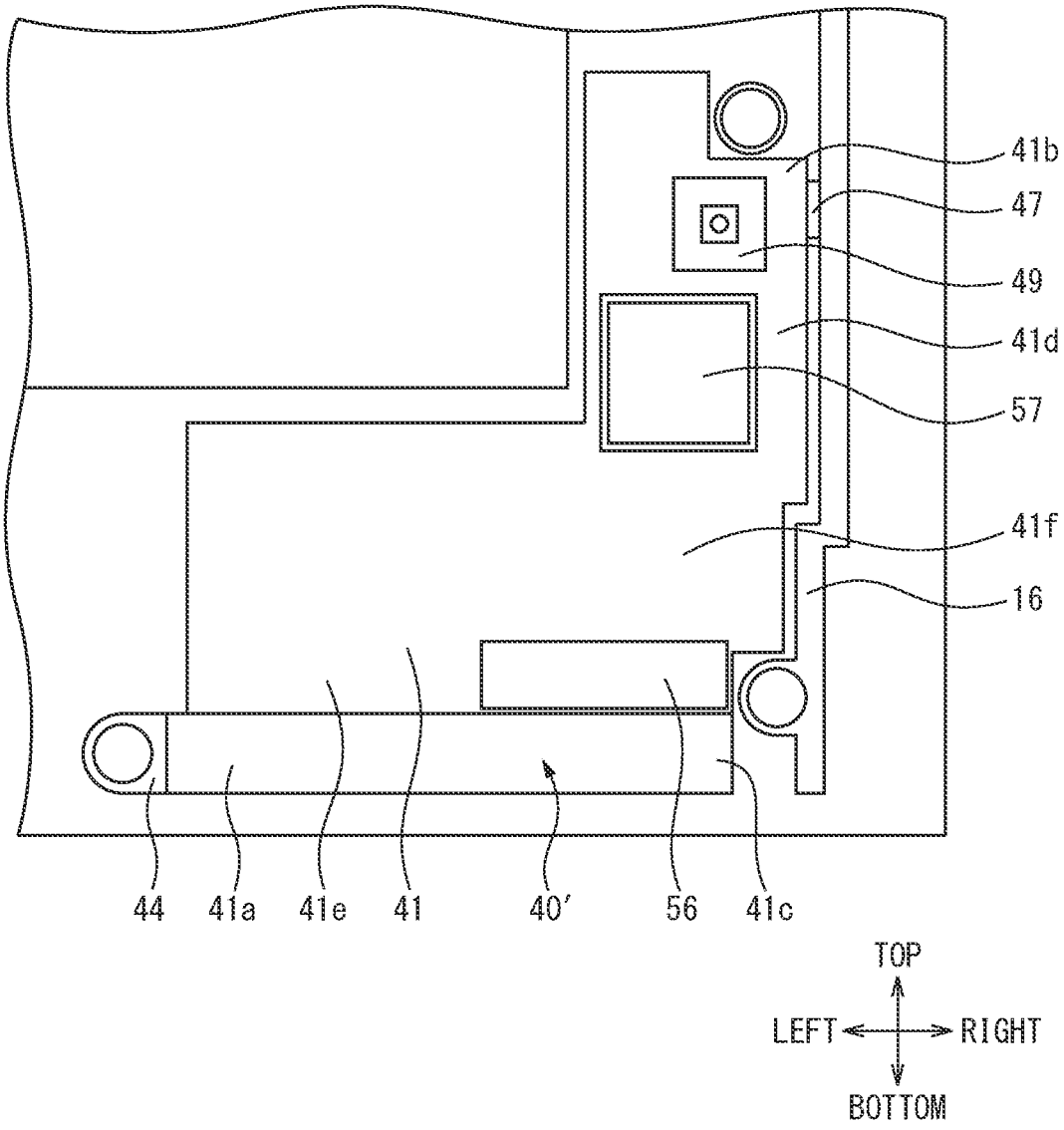
FIG. 17 is a back view of the bottom right region of the front wall member to which the cover member is attached.

Next, referring to FIGS. 16 and 17, the configuration of the electronic device 1 at the bottom right region of the housing 2 will be explained. FIG. 16 is a cross-sectional perspective view of the bottom right region of the housing 2, seen along the line XVI-XVI of FIGS. 1 to 3. FIG. 17 is a back view of the bottom right region of the front wall member 6 to which a cover member is attached.

As shown in FIG. 16, at the bottom right region of the housing 2 as well, the electronic device 1 has, in a direction from the front to the back, the front wall member 6, a speaker 30, cover member 40', the circuit board 60, and the back wall member 7. Below, the parts different from the bottom left region of the housing 2 will mainly be explained.

As shown in FIG. 17, at the back surface of the cover member 40' attached to the bottom right region of the front wall member 6, a fifth cushion member 56 and a sixth cushion member 57 are adhered. The fifth cushion member 56 is arranged near a third edge part 41*c* of the cover member 40'. On the other hand, the sixth cushion member 57 is arranged near a second edge part 41*b*.

Further, as shown in FIG. 16, a ventilation member 59 forming part of the housing 2 is arranged behind the cover member 40'. The ventilation member 59 is provided at the back bottom transition wall 20 and has ventilation holes so as to allow ventilation of the inside of the housing 2. The ventilation member 59 is fastened to the front wall member 6 by screws (not shown). Note that, the ventilation member 59 may be fastened to a member other than the front wall member 6 forming part of the housing 2. Therefore, the ventilation member 59 is one example of a fastening member arranged behind the cover member 40' and fastened to the housing 2.

In addition, as shown in FIG. 16, at the back of the cover member 40', a second metal plate 66 is provided. The second metal plate 66, in the same way as the first metal plate 65, is arranged so as to cover the circuit board 60 and other electronic components and, for example, functions as a shield preventing entry of noise. The second metal plate 66 is also fastened to the front wall member 6 by screws (not shown). Note that, the second metal plate 66 may be fastened to a member configuring the housing 2 other than the front wall member 6. Therefore, the second metal plate 66 is one example of a fastening member arranged behind the cover member 40' and fastened to the housing 2.

As shown in FIG. 16, the fifth cushion member 56 is arranged between the cover member 40' and the ventilation member 59. Therefore, the fifth cushion member 56 is one example of a first elastic member provided between the cover member 40 and ventilation member 59 (fastening member). The fifth cushion member 56 has a thickness greater than the clearance formed between the back surface of the cover member 40' and the front surface of the ventilation member 59 when the cover member 40' and ventilation member 59 are attached to the housing 2.

Further, the sixth cushion member 57 is arranged between the cover member 40' and the second metal plate 66. Therefore, the sixth cushion member 57 is one example of a first elastic member provided between the cover member 40' and the second metal plate 66 (fastening member). The sixth cushion member 57 has a thickness greater than the clearance formed between the back surface of the cover member 40' and the front surface of the second metal plate 66 when the cover member 40' and second metal plate 66 are attached to the housing 2.

As a result, the cover member 40' is pushed to the front by the fifth cushion member 56 and the sixth cushion member 57. Therefore, a state where the cover member 40' rises up separating from the front wall member 6 is kept from occurring, and accordingly the acoustic performance of the electronic device 1 is kept from falling.

Above, preferred embodiments according to the present invention were explained, but the present invention is not limited to these embodiments and can be corrected and changed in various ways within the language of the claims.

The invention claimed is:

1. An electronic device having a speaker, the electronic device comprising:

a housing having a front wall member including a front wall and a back wall member including a back wall;

a cover member detachably attached to the front wall member;

a fastening member arranged behind the cover member and fastened to the housing; and a first elastic member provided between the cover member and the fastening member, wherein the cover member, the fastening member, and the first elastic member are arranged inside the housing, the speaker is arranged between the front wall member and the cover member, the front wall member and the cover member are formed so that a closed space is defined by a back surface of a vibration plate of the speaker, the front wall member, and the cover member, the front wall member is provided with an opening communicating from outside of the housing to the front surface of the vibration plate of the speaker, and the first elastic member is configured to contact the cover member and the fastening member.

2. The electronic device according to claim 1, wherein the front wall member has a loop-shaped rib extending from an inside surface of the front wall toward the back, the speaker is arranged inside the loop-shaped rib, and the cover member is attached to a back end of the loop-shaped rib.

3. The electronic device according to claim 1, wherein the cover member is fastened to the front wall member at two different locations of the outer circumferential part of the cover member, and the first elastic member is arranged so as to contact a different location of the cover member from the location fastened to the front wall member.

4. The electronic device according to claim 1, wherein the cover member is provided with a ceiling part having a shape obtained by removing one edge part of a rectangular shape and is fastened to the front wall member at an edge part adjoining the removed edge part, and the first elastic member is arranged so as to contact the cover member at a region nearer to the edge part of the cover member not fastened to the front wall member than the edge part of the cover member fastened to the front wall member.

5. The electronic device according to claim 4, wherein the cover member is fastened to two edge parts adjoining the removed edge part.

6. The electronic device according to claim 4, wherein one edge part of the cover member fastened to the front wall member is provided with a tab and the other edge part of the cover member fastened to the front wall member is provided with a screw opening for passing a screw, and the cover member is fastened by the tab being inserted into a tab opening or tab recess formed in the front wall member and by a screw passed through the screw opening being screwed into the front wall member.

7. The electronic device according to claim 4, wherein the cover member is attached to the front wall member so that an edge part positioned diagonally from the removed edge part is positioned at an edge part of the housing.

8. The electronic device according to claim 1, wherein the cover member is provided with an L-shaped ceiling part having a first part extending in a first direction and a second part extending in a second direction perpendicular to the first direction, and the first elastic member is arranged so as to contact the cover member in a region including a part where the first part and the second part cross.

9. The electronic device according to claim 8, wherein the cover member is fastened to the front wall at an end part of the first part at an opposite side to the crossing part side and at an end part of the second part at an opposite side to the crossing part side.

10. The electronic device according to claim 8, wherein the cover member is attached to the front wall member so that the crossing part is positioned at an edge part of the housing.

11. The electronic device according to claim 1, wherein the first elastic member is adhered to the fastening member and is not adhered to the cover member.

12. The electronic device according to claim 1, wherein a second elastic member is arranged between the cover member and the front wall member, and the cover member and the front wall member are detachably adhered to each other by the second elastic member.

13. The electronic device according to claim 12, wherein the second elastic member formed to have a thickness larger than a clearance between the cover member and the front wall member when the cover member is fastened to the front wall member.

14. The electronic device according to claim 13, wherein the second elastic member is arranged between an end surface at the front wall member side of the cover member and an end surface at the cover member side of the front wall member, and is formed so as to stick out from between these end surfaces inward or outward.

15. The electronic device according to claim 1, wherein the fastening member is fastened to the front wall member.

16. The electronic device according to claim 1, wherein the back wall member has a back wall rib extending from an inside surface of the back wall toward the fastening member.

17. The electronic device according to claim 16, wherein the back wall rib is arranged so as to face the fastening member more at the first elastic member side than the location where the fastening member is fastened to the housing.

18. The electronic device according to claim 16, wherein the fastening member is a circuit board, the circuit board is provided with a slot in which a peripheral device is loaded through an opening provided at the back wall member from outside the housing, and the back wall rib is arranged around the slot.

19. The electronic device according to claim 16, wherein the front wall member is made of a metal and the back wall member is made of a plastic.

20. The electronic device according to claim 16, wherein the cover member is made of a plastic harder than the back wall member.

* * * * *